US009945648B2

(12) United States Patent
Grace

(10) Patent No.: US 9,945,648 B2
(45) Date of Patent: Apr. 17, 2018

(54) ARCHERY BROADHEAD AND RELATED METHOD OF USE

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 15/335,497

(22) Filed: Oct. 27, 2016

(65) Prior Publication Data

US 2017/0191808 A1 Jul. 6, 2017

Related U.S. Application Data

(60) Provisional application No. 62/274,518, filed on Jan. 4, 2016.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 3,036,395 A * 5/1962 Nelson ..... F42B 30/14 43/6
4,973,060 A * 11/1990 Herzing ..... F42B 6/08 473/583
5,941,784 A * 8/1999 Mizek ..... F42B 6/08 473/584
6,287,224 B1 * 9/2001 Liechty, II ..... F42B 6/08 473/583
6,517,454 B2 * 2/2003 Barrie ..... F42B 6/08 473/583
6,626,776 B2 * 9/2003 Barrie ..... F42B 6/08 473/583
7,771,298 B2 * 8/2010 Pulkrabek ..... F42B 6/08 473/583
8,007,382 B1 * 8/2011 Sanford ..... F42B 6/08 473/583
8,105,187 B1 * 1/2012 Sanford ..... F42B 6/08 473/583
8,128,521 B1 * 3/2012 Ulmer ..... F42B 6/08 473/583

(Continued)

*Primary Examiner* — Alexander Niconovich
(74) *Attorney, Agent, or Firm* — Warner Norcross and Judd, LLP

(57) ABSTRACT

A broadhead is provided including a ferrule defining a slot. A blade is movable within the slot from a retracted mode to a deployed mode. The blade includes a lever arm projecting from the slot on a ferrule side opposite a cutting edge. The blade can include an interference projection that engages an exterior of the ferrule to retain the blade in the retracted mode. The blade can include a retention arm that selectively engages the ferrule to hold the blade in the retracted mode or the deployed mode. The broadhead can include a collar selectively disposed in a collar recess of the blade to hold the blade in the retracted mode. The broadhead can include a plunger and/or pivotable pawl that selectively engage the blade to hold it in a desired mode.

1 Claim, 27 Drawing Sheets

(56) References Cited

U.S. PATENT DOCUMENTS

| | | | | |
|---|---|---|---|---|
| 8,197,367 | B2 * | 6/2012 | Pulkrabek | F42B 6/08 473/583 |
| 8,287,407 | B1 | 10/2012 | Sanford | |
| 8,313,399 | B2 * | 11/2012 | Sanford | F42B 12/34 473/583 |
| 8,393,983 | B1 * | 3/2013 | Sanford | F42B 6/08 473/583 |
| 8,398,510 | B1 * | 3/2013 | Mizek | F42B 6/08 473/583 |
| 8,771,112 | B2 * | 7/2014 | Sanford | F42B 12/34 473/583 |
| 8,911,311 | B1 * | 12/2014 | Mizek | F42B 6/04 473/583 |
| 8,926,457 | B2 * | 1/2015 | Treto | F42B 6/08 473/583 |
| 9,017,191 | B2 * | 4/2015 | Treto | F42B 6/08 473/583 |
| 9,028,349 | B2 * | 5/2015 | Budris | F42B 6/08 473/583 |
| 9,267,773 | B2 * | 2/2016 | Mizek | F42B 6/08 |
| 2009/0203477 | A1 * | 8/2009 | Mizek | F42B 6/08 473/583 |

* cited by examiner

ARCHERY BROADHEAD AND RELATED METHOD OF USE

BACKGROUND OF THE INVENTION

The present invention relates to archery products, and more particularly to mechanical archery broadheads having one or more blades that deploy from a retracted mode to a deployed mode.

Broadheads are devices that are attached to a forward end of an arrow shot from an archery bow. Broadheads typically include blades having cutting edges that enhance the penetration and cutting action upon impact with game, to thereby harvest game quickly and humanely.

There are several types of broadheads, one of which is known as a mechanical broadhead. A mechanical broadhead typically includes blades that move relative to a ferrule to prevent undesirable aerodynamic steering of the front of an arrow, to which the broadhead is attached, and which can cause the arrow to deviate from a desired trajectory.

Most conventional mechanical broadheads are operable in a retracted mode and a deployed mode. In the retracted mode, substantial portions of the blades are hidden within a body of the broadhead, for example, during flight of an arrow, so as to reduce undesirable steering effects. When the broadhead impacts a target, such as game, the blades are designed to open to a deployed mode and thereby expose the cutting edges of the blades and enhance penetration and cutting action thereof.

Many mechanical broadheads include complex mechanisms to hold the blades in the retracted mode and/or to allow the blades to deploy to the deployed mode. Some of these mechanisms can allow the blades to open and deploy prematurely, which can result in poor penetration into the target. Other mechanisms fail to open to the deployed mode because of an inappropriate closing force on the blades via the mechanism. Further, with such complex mechanisms, when dirt, debris and fluids enter parts of the broadhead, this can significantly affect reliable, consistent deployment of the blades.

Accordingly, there remains room for improvement in the field of mechanical broadheads so as to provide more efficient and consistent retention of blades in a retracted mode, and deployment of blades to a deployed mode.

SUMMARY OF THE INVENTION

A broadhead is provided including a ferrule defining a slot, and one or more blades that are movable, optionally pivotable and/or slidable, within the slot from a retracted mode to a deployed mode. The blade can include one or more mechanisms that selectively engage the blade to assist in holding the blade in the retracted mode and/or deployed mode.

In one embodiment, the broadhead can include a longitudinal axis and a first cutting blade can be mounted in the slot and adapted to pivot about a pivot axis, from a retracted, in flight mode to a deployed, penetrating mode. The first cutting blade can include a cutting edge disposed opposite an interior edge on the blade. The first cutting blade can include a first lever arm extending generally from the interior edge. The first lever arm can project from the slot on a first side of the longitudinal axis, opposite a second side of the longitudinal axis from which the cutting edge extends from the longitudinal slot.

In a further embodiment, the cutting edge can project outwardly, away from the ferrule in both the retracted mode and the deployed mode. Optionally, the cutting edge extends away from the slot and/or ferrule throughout its movement. In some cases, however, the cutting blades of the broadhead can be configured so that they can freely pivot forwardly, toward a tip of the broadhead to prevent a barbing action of the broadhead, thereby allowing game to withdraw the broadhead.

In another embodiment, the broadhead can be constructed so that when the one or more blades are disposed in the longitudinal slot, the cutting edges are configured to pivot outward with the remainder of the blade, generally away from the longitudinal axis and/or a plane through the longitudinal axis. Where the blades include distal tips, those distal tips can swing outward, away from the ferrule when transitioning from a retracted mode to a deployed mode. Optionally, the distal tips follow a circumferential and/or curvilinear path that is distanced from a pivot axis of the respective cutting blades.

In still another embodiment, the broadhead can include a first cutting blade and a second cutting blade, each having cutting edges that swing outward, generally away from the ferrule in the deployed mode to increase the cutting surface area of the broadhead. The cutting blades each can include an interior edge, also referred to as an inner edge. The inner edge can include a lever arm. The cutting edge of the first cutting blade and a lever arm of the second cutting blade can extend outward from the ferrule on a first side of longitudinal axis. Likewise, the cutting edge of the second cutting blade and a lever arm of the first cutting blade can extend outward from the ferrule on a second side of the longitudinal axis, opposite the first side.

In even another embodiment, the first cutting blade can include a first interference projection that engages a second exterior surface of the ferrule adjacent the slot to retain the first cutting blade in the retracted mode. The second cutting blade can include a second interference projection that engages a first exterior surface of the ferrule, adjacent the slot to retain the second cutting blade in the retracted mode. The first exterior surface of the ferrule can be disposed generally on an opposite side of the longitudinal axis of the ferrule from the second exterior surface.

In yet another embodiment, the first cutting blade can be rotatable and simultaneously slidable within the longitudinal slot from a retracted mode in which the cutting edge lies adjacent the ferrule, to a deployed mode in which the cutting edge extends outward and away from the ferrule. The first cutting blade can include a first retention arm projecting from the interior edge, distal from the first lever arm. The first retention arm pivots and slides with a remainder of the first cutting blade as the first cutting blade transitions from the retracted mode to the deployed mode.

In a further embodiment, an interior edge of the blade can define a collar recess. A collar can be joined with the ferrule. The collar can be selectively disposed within the collar recess of the inner edge, and can selectively hold the first cutting blade in the retracted mode. The collar optionally can be deformable to enable the first cutting blade to transition from the retracted mode to the deployed mode, during which transition the collar exits the collar recess.

In still a further embodiment, the broadhead can include a plunger, optionally joined with a biasing element, where the plunger projects into the longitudinal slot defined by the ferrule. The first cutting blade can include a first retention arm projecting from the inner edge of the cutting blade. The first retention arm can include a support portion that engages the plunger to assist in holding the first cutting blade in the retracted mode, but which disengages the support arm to allow the blade to transition to a deployed mode. The first retention arm optionally can include a hold open portion that engages the plunger to assist in holding the first cutting blade in the deployed mode.

In still yet a further embodiment, the plunger can include an upper surface that engages the support portion. The plunger also can include a shoulder or other surface contour adjacent the upper surface that engages the hold open portion.

In even a further embodiment, the broadhead includes a biasing element joined with the ferrule that engages the first retention arm to assist in retaining the first cutting blade in the retracted mode. The biasing element is selectively deformable when the first lever arm urges rotation of the first cutting blade, thereby allowing the first cutting blade to transition from the retracted mode to the deployed mode. The biasing element can engage the first retention arm to assist in retaining the first cutting blade in the deployed mode.

In yet a further embodiment, the biasing element can include a first tip that is movable from a first position in which the first tip extends outward from the ferrule when the first cutting blade is in the retracted mode, to a second position in which the first tip is adjacent the longitudinal slot when the first cutting blade is in the deployed mode.

In yet even a further embodiment, the biasing element includes a central portion that extends through the ferrule, as well as a first tip and a second tip spaced from one another. The first tip can be disposed on a first side of the longitudinal axis. The second tip can be disposed on a second side of the longitudinal axis that is opposite the first side. The biasing element can be constructed from a resilient material so that the first and second tips rebound toward one another when the first and second cutting blades transition from the retracted mode to the deployed mode.

In another further embodiment, the broadhead can include a pawl pivotally joined with the ferrule. The pawl can be configured to selectively engage a first retention arm of the first cutting blade in a first pawl position to assist in retaining the first cutting blade in the retracted mode. The pawl optionally can be configured to selectively engage the retention arm in a second pawl position to assist in retaining the first cutting blade in the deployed mode.

In yet another further embodiment, the broadhead can include a biasing element joined with the ferrule and configured to rotate the pawl about a pivot axis. The pawl can pivot when a first lever arm is impacted and urges rotation of the first cutting blade, thereby allowing the first cutting blade to transition from the retracted mode to the deployed mode. The pawl can engage the first retention arm to assist in retaining the first cutting blade in the deployed mode.

The current embodiments of the broadhead and related methods of use provide benefits regarding the retention and deployment of blades in mechanical broadheads that previously have been unachievable. With the current embodiments, the cutting blades of the broadheads can be consistently held and deployed. The mechanisms can prevent unwanted pre-deployment of the blades during flight or encounters with non-target obstacles in the flight path of the broadhead and associated arrow. Further, the interface of the holding mechanisms can be fine-tuned to deploy under preselected, precise forces as applied to the blades and optional lever arms thereof.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
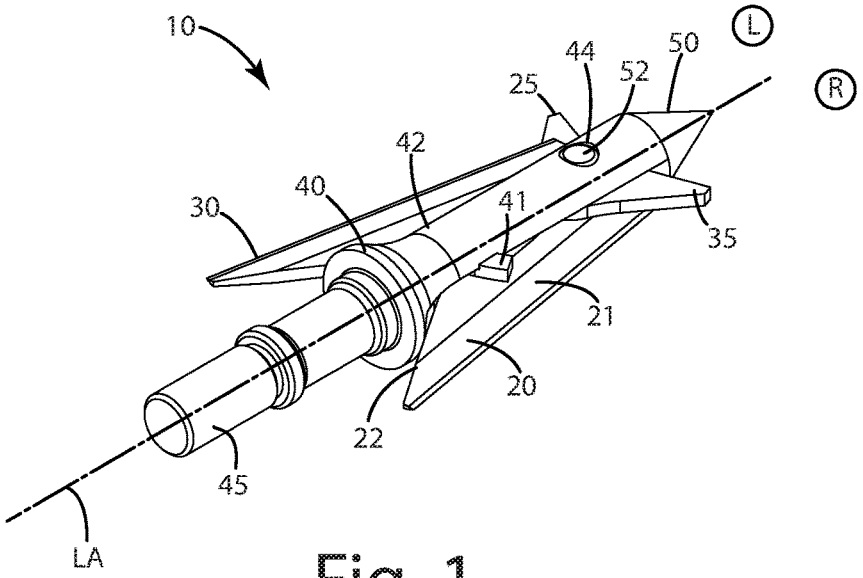
FIG. 1 is a perspective view of a broadhead of a current embodiment with cutting blades thereof in a retracted mode.
Figure 2:
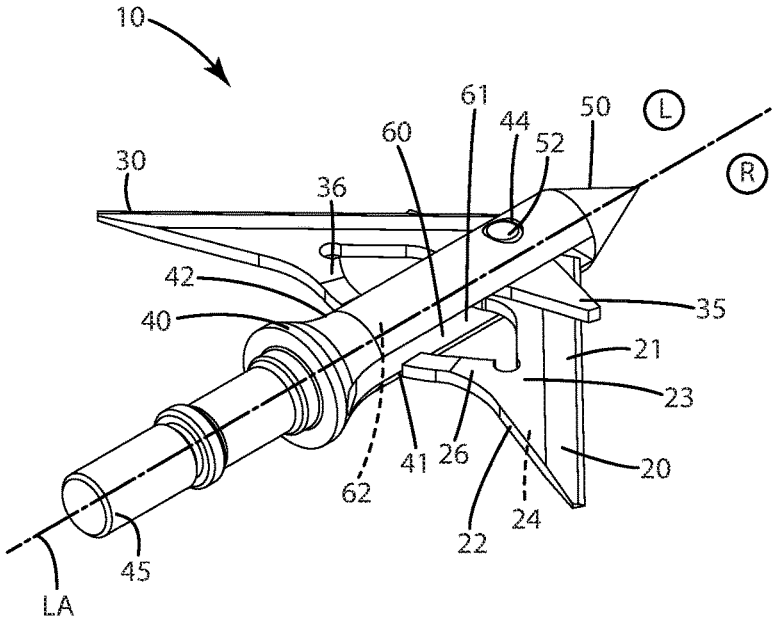
FIG. 2 is a perspective view of the broadhead with the cutting blades thereof in a deployed mode.
Figure 3:
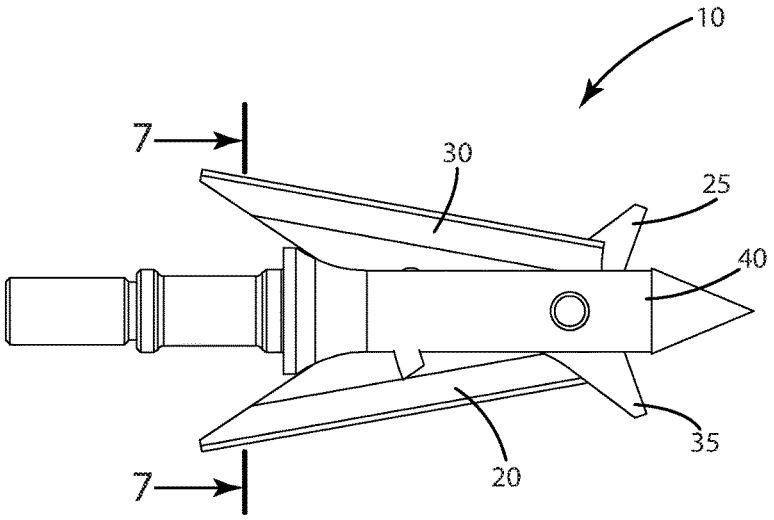
FIG. 3 is a top view of the broadhead with the cutting blades thereof in a retracted mode.
Figure 4:
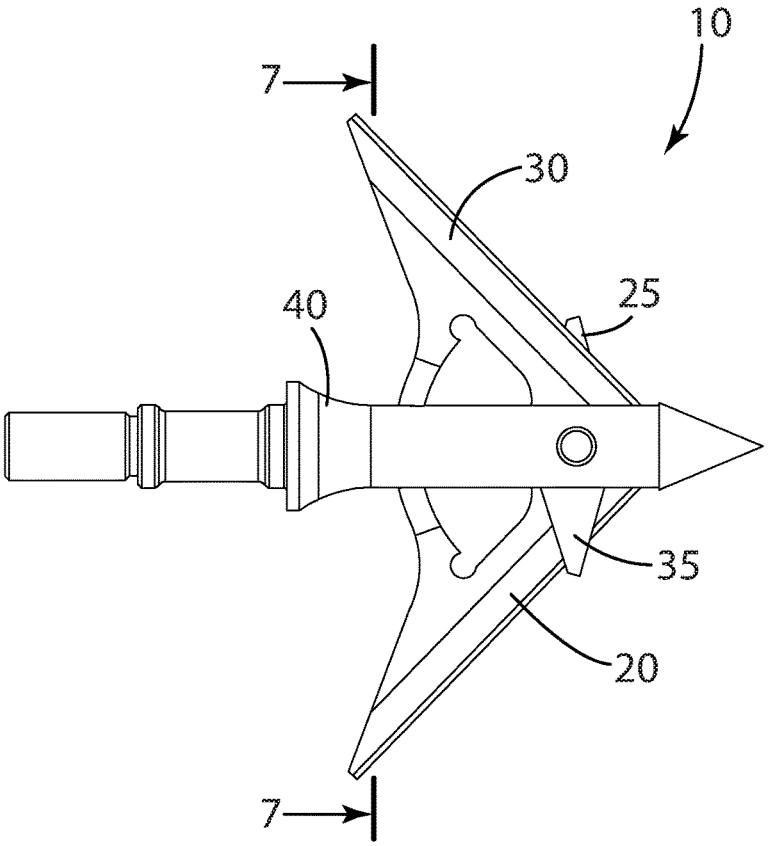
FIG. 4 is a top view of the broadhead with the cutting blades thereof in a deployed mode.

A current embodiment of a broadhead is illustrated in FIGS. 1-15, and generally designated 10. This broadhead 10 can be in the form of a mechanical broadhead that has one or more moving parts. In particular, the first cutting blade 20 and second cutting blade 30 are configured to move from a retracted mode as shown in FIG. 1 to a deployed mode as shown in FIG. 2. Although shown in the form of a rearward pivoting style mechanical broadhead, the various features and constructions herein can be adaptable for other types of mechanical broadheads, such as forward pivoting broadheads and/or certain rearward camming broadheads.

The broadhead 10 can include an elongated ferrule 40. The ferrule 40 can be constructed from a single integral piece of metal, such as steel, aluminum and/or composite. Optionally, the ferrule can be constructed from multiple components that are fastened to one another using fasteners such as screws, pins or rivets. A tip 50 can be secured at the end of the ferrule. This tip can include a sharpened point to penetrate a target surface. Although not shown, tip 50 can include one or more bleeder blades or smaller cutting blades to assist in penetrating and/or slicing through a target.

The elongated ferrule 40 can include a longitudinal axis LA that generally bisects the ferrule into corresponding left L and right R sides, which are disposed opposite one another across the longitudinal axis LA. The elongated ferrule 40 also can include threads 45 which are configured to thread into an arrow insert to secure the ferrule to an arrow.

The elongated ferrule 40 can define a longitudinal slot 60 that extends along a substantial length of the elongated ferrule. The longitudinal slot 60 can include a first sidewall 61 and a second sidewall 62. The sidewalls can generally be of a planar configuration disposed across from one another, with the slot being defined therebetween. The sidewalls can be joined with a bottom wall 63 of the slot.

The longitudinal slot 60 can extend through the ferrule 40 from the first side R to the second side L. Adjacent the slot 60 on the first side R, the ferrule can include a first exterior surface 41. Adjacent the slot 60 on the second side L, the ferrule can include a second exterior surface 42. Generally, these first and second exterior surfaces 41 and 42 of the ferrule are disposed diametrically opposite one another across the longitudinal axis LA. Of course, in other constructions, the surfaces can be slightly offset from one another depending on the number of blades and the configuration of the ferrule.

Figure 5:
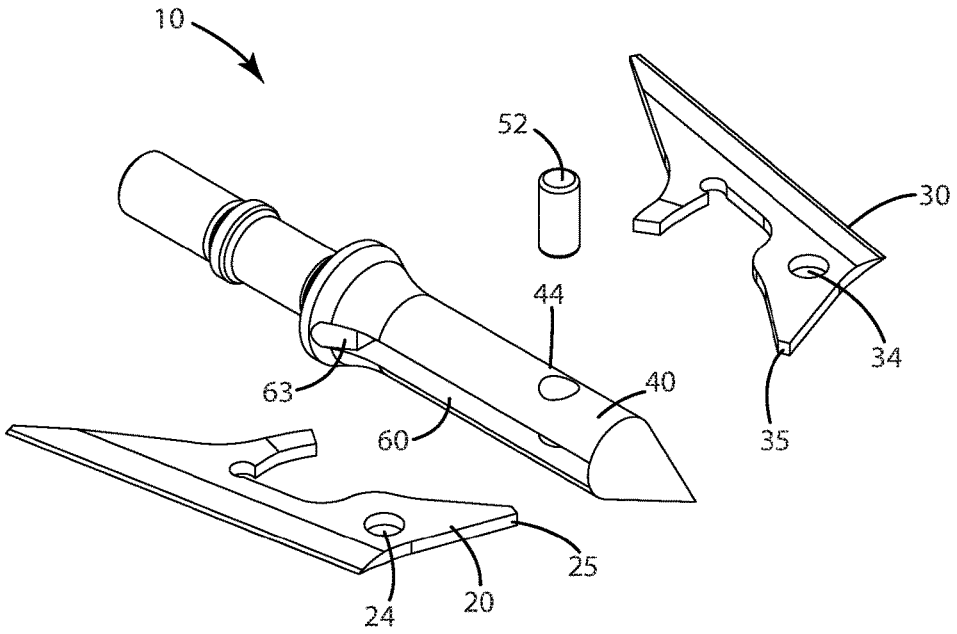
FIG. 5 is an exploded view of the broadhead with the blades oriented in a retracted mode.
Figure 6:
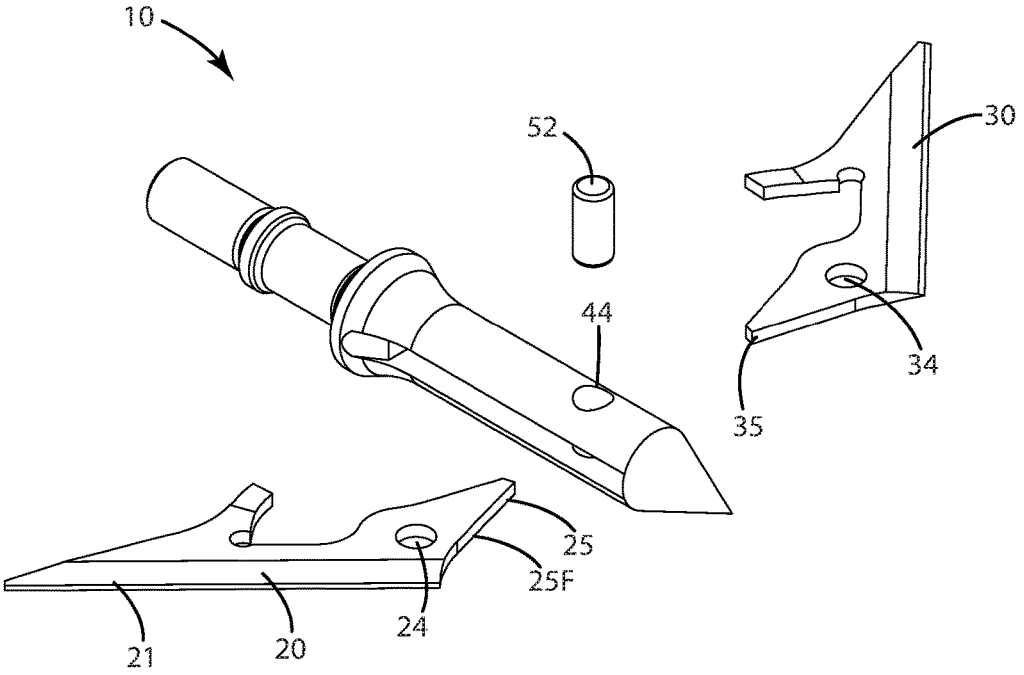
FIG. 6 is an exploded view of the broadhead with the blades oriented in a deployed mode.
Figure 7:
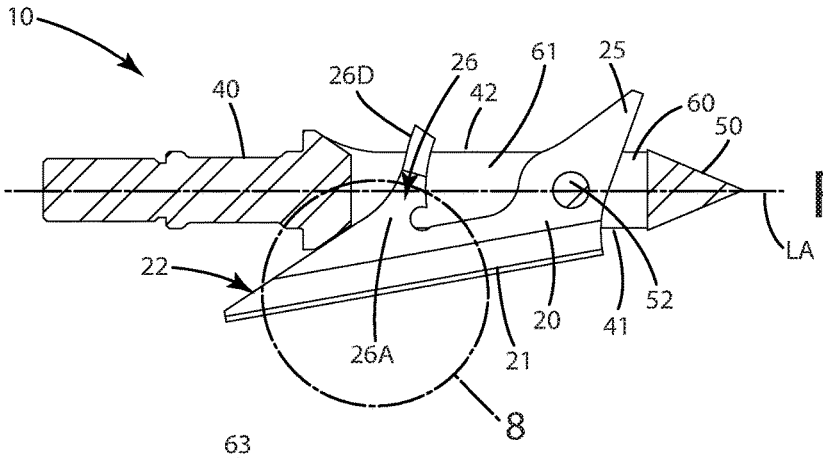
FIG. 7 is a section view of the broadhead with the blades oriented in a retracted mode taken along line 7-7 of FIG. 3.

The ferrule 40 can define a pin aperture 44, shown in FIGS. 5 and 6. The pin aperture 44 can extend through the ferrule and into the longitudinal slot 60 from opposing upper and lower surfaces of the ferrule. In some cases, the pin aperture 44 can be optionally threaded to receive threads of a pin 52. This retaining pin 52 can extend through the pin aperture 44, as well as through blade apertures 24, 34 that are defined by the respective first 20 and second 30 cutting blades. In effect, the pin 52 pivotally and/or rotatably joins both the first and second cutting blades to the ferrule. Although shown as a generally cylindrical pin, the retaining pin 52 can be of other geometric shapes. For example, it can have polygonal, elliptical, triangular, or other cross sectional shapes, depending on the particular configuration and the desired rotation characteristics of the blades.

In this embodiment, as well as the others described herein, the first cutting blade 20 and the second cutting blade 30 can be identical and/or mirror constructs of one another. Therefore, only the first cutting blade 20 will be described in substantial detail here and later in connection with other embodiments. The first cutting blade 20 can include a cutting edge 21 and an opposing inside edge 22. The cutting edge 21 can be honed, etched and/or sharpened on a substantial portion of its length to assist in cutting and/or penetrating a target material. The inside edge 22, also referred sometimes herein as the interior edge, can be unsharpened and can include a rounded edge or a flat planar edge along a portion of its length. The inside edge also can include multiple surface features and/or other components that assist in retaining the cutting blades in the retracted mode and/or the deployed mode as further described below.

As shown in FIGS. 1, 2 and 14, 15, the first cutting blade can include a first side surface 23 that lays in a first plane 1P and a second side surface 24 that lays in a second plane 2P which can be generally parallel to the first plane 1P. The first side surface and second side surface can be located across from one another on opposite sides of the cutting blade 20. Optionally, where the pin 52 is included to retain the cutting blades in connection with the ferrule 40, the pins can extend through the blades, in particular, through the blade apertures 24 and 34. In turn, the pins can extend through the first plane and the second plane, as well as a first side surface and a second side surface of the respective blades. Further optionally, the pin can be restrained by the ferrule and joined with the first and second cutting blades so that those cutting blades cannot move linearly along the longitudinal axis LA. Instead, the cutting blades primarily pivot inward and outward relative to the longitudinal axis, along curvilinear paths, rather than moving along the longitudinal axis in this embodiment.

Each of the respective cutting blades in the embodiments described herein can be pivotally joined with the ferrule. The first cutting blade can be movable from a retracted mode in which the cutting edge 21 of the cutting blade 20, lies adjacent the ferrule. The cutting edge 21 in the retracted mode can be optionally parallel to the longitudinal axis LA of the broadhead, or further optionally between 1° to 20° offset from the longitudinal axis LA. Upon deployment of the cutting blades, the cutting edges of the respective cutting blades extend and protrude generally outward and away from the ferrule. The cutting edge 21 in the deployed mode can be offset at an angle between optionally about 15° to about 60°, or further optionally about 25° to about 45° relative to the longitudinal axis LA of the broadhead. In other applications, the aforementioned offsets can be varied depending on the application.

As shown in FIGS. 1, 2 and 5, 6, each of the first 20 and second 30 cutting blades can include respective lever arms 25 and 35. The lever arms of the respective cutting blades extend outward from the ferrule in the longitudinal slot on the opposite side of the ferrule than the cutting edge of the respective cutting blades. As an example, the first lever arm 25 of the first cutting blade 20 extends outward adjacent the second exterior surface 42 of the ferrule 40 adjacent the longitudinal slot 60, while the cutting edge 21 extends outward from the first side exterior surface 41 of the ferrule adjacent the longitudinal slot. The cutting edge 21 can extend from a first side R of the longitudinal axis, while the lever arm 25 extends from an opposite second side L of the ferrule when the cutting blades are in the retracted mode, as shown for example in FIGS. 1 and 5. Optionally, the first lever arm 25 can be disposed on the opposite side of the blade aperture 24 from the cutting edge 21. The forward facing surface 25F of the lever arm is unsharpened and can form a flat planar surface. This can facilitate rapid deployment of the cutting edge 21 away from the longitudinal axis in transitioning the blade from the retracted mode to the deployed mode. In some cases, however, this front surface 25F can be sharpened and/or honed to form a cutting edge in certain applications.

As shown in FIGS. 7-15, each of the cutting blades 20 and 30 can include respective retention arms 26, 36. The retention arms generally include components that engage certain exterior surfaces of the ferrule adjacent the slot to retain the cutting blades in either the retracted mode and/or the deployed mode. As an example, the first retention arm 26 extends from an inner edge 22 of the blade 20. The retention arm 26 extends far enough from the inner edge so that a portion of the retention arm extends beyond the second surface 42 of the ferrule while the cutting edge 21 of the same blade extends beyond and/or adjacent the first exterior surface 41 of the ferrule on the opposite side of the longitudinal axis LA.

Figure 8:
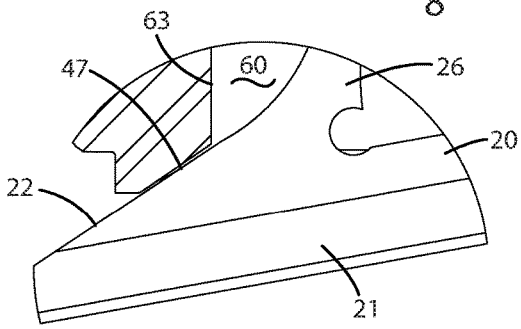
FIG. 8 is a close up of the section view of the broadhead with the blades oriented in a retracted mode taken from FIG. 7.
Figure 9:
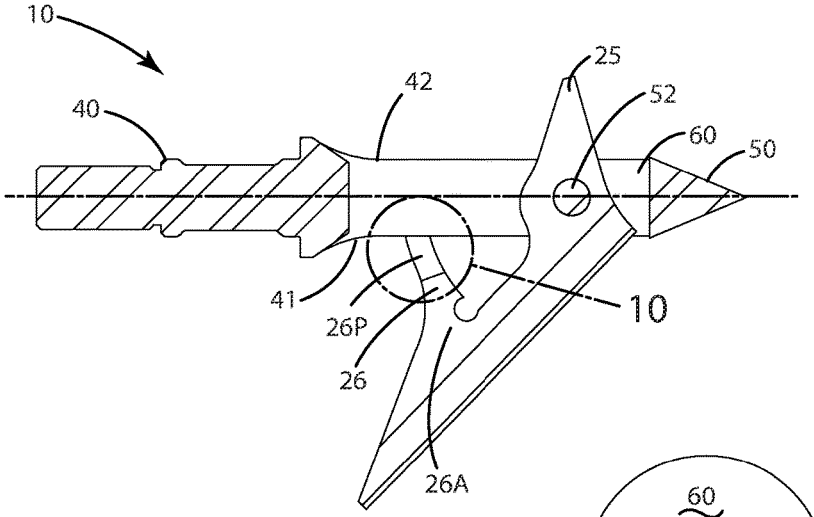
FIG. 9 is a section view of the broadhead with the blades oriented in a deployed mode taken along lines 9-9 of FIG. 4.
Figure 10:
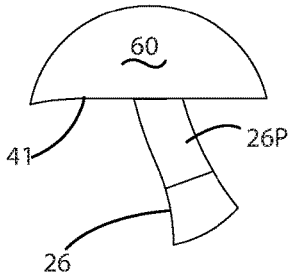
FIG. 10 is a close up view of a retention arm engaging an exterior surface of a ferrule of the broadhead.
Figure 11:
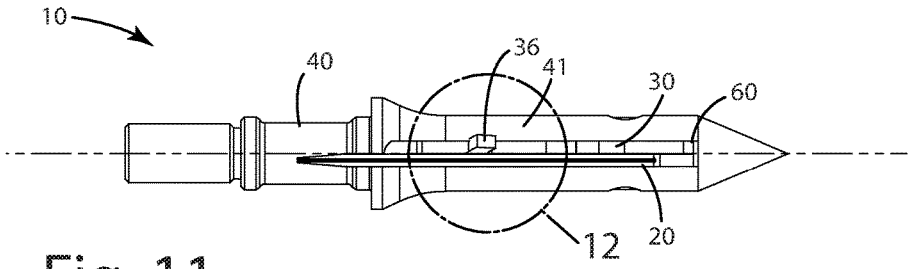
FIG. 11 is a side view of the broadhead in a retracted mode with an interference projection extending from the cutting blade.

In the retracted mode, the first retention arm 26 can engage the slot 60 and/or an intersection or corner between the slot inner wall 61 and the second exterior surface 42 of the ferrule. This engagement can effectively hold the first cutting blade 20 in the retracted mode. In addition to the retention arm 26 engaging the second exterior surface 42, the interior edge 22, as shown in FIG. 8 can engage a rounded and/or chamfered portion 47 of the ferrule 40, adjacent the bottom wall 63 of the slot. This can provide additional holding forces against the first cutting blade 20 to hold it in the retracted mode.

Figure 15:
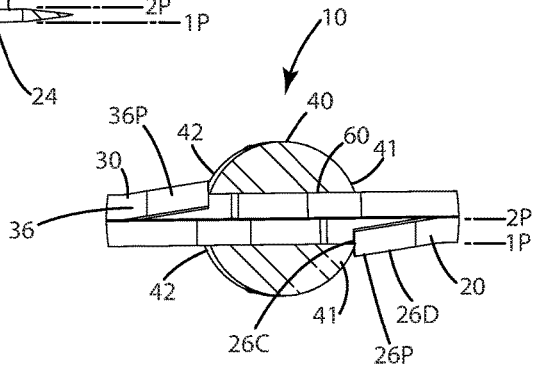
FIG. 15 is a close-up of the section view of the interference projections taken from FIG. 14.

In the deployed mode, the first retention arm 26 of the first cutting blade 20 can engage the first exterior side surface 41 of the ferrule as shown in FIG. 15. In this configuration, the retention arm can effectively hold the first cutting blade 20 in the deployed mode.

Figure 14:
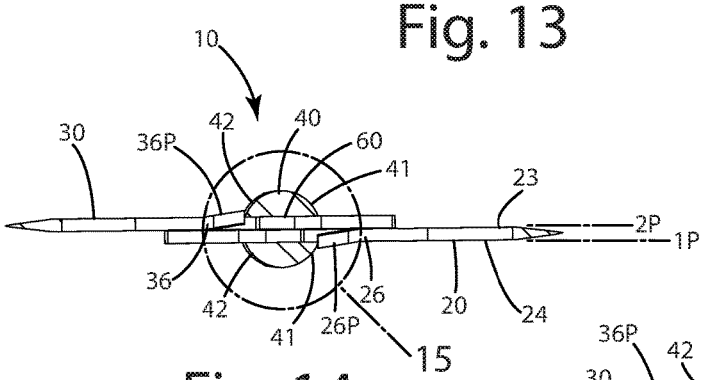
FIG. 14 is a top section view of the broadhead in the deployed mode, with the interference projections engaging exterior surfaces of the ferrule to hold the blades in the deployed mode.

The retention arms 26 and 36 of the respective cutting blades 20 and 30 can include certain components. For example, the first retention arm 26 can include a first interference projection 26P. The second retention arm 36 can include a second interference projection 36P. With regard to the first cutting blade 20, the first interference projection can extend beyond the first plane 1P as shown in FIGS. 14 and 15. This interference projection 26P can be configured so that it engages the first exterior side surface 41 of the ferrule 42 retain the blade in the deployed mode. When the cutting blades are closed however, this interference projection 26P engages the opposing second side surface of the ferrule 40 to assist in retaining the cutting blade in the retracted mode.

Figure 12:
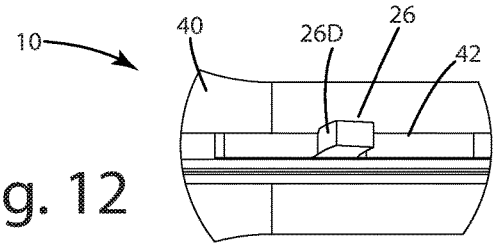
FIG. 12 is a close up of the section view with the blades oriented in a retracted mode taken from FIG. 11.
Figure 13:
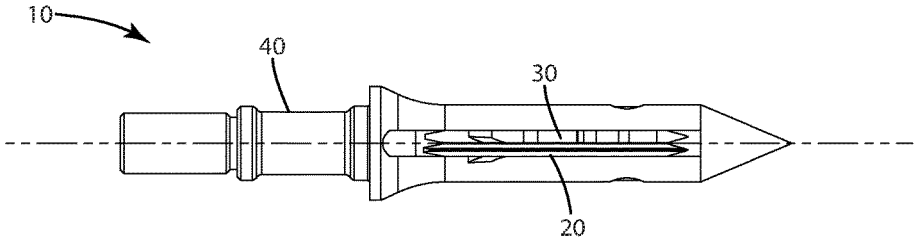
FIG. 13 is a side view of the broadhead in a deployed mode, with interference projections engaging certain exterior surfaces of the ferrule to hold the blades in the deployed mode.

Optionally, the first retention arm 26 can include a first arm portion 26A that is adjacent the inside edge 22. This first arm portion 26A can be joined with the first interference projection 26P, which also can be referred to as a second arm portion. This second arm portion 26P can be distal from the inside edge and can extend outward therefrom. The second arm portion and/or interference projection 26P can be bent or formed at an angle relative to the remainder of the blade so that it projects upward through the first plane 1P, as shown for example in FIGS. 12, 14 and 15. Generally, the interference projection can extend upward above the first plane 1P and above the plane of the side surface 23 of the cutting blade 20. In some cases, the interference projection can be rounded and/or can include a bump that projects upward and through the first plane to form the first interference projection of the first cutting blade. Optionally, in some cases the interference projection 26P can include an angled surface 26D and a contact edge 26C. The contact edge 26C can be configured to engage the first exterior surface 41 of the ferrule to retain the cutting blade in the deployed mode. The angled portion enables that edge to project outwardly from the cutting blade to provide the desired location of the contact edge so that it engages the exterior surface of the ferrule. The angled surface 26D also can be configured so that it at least partially engages the second exterior surface 42 of the ferrule to retain the first cutting blade 20 in the retracted mode as shown in FIG. 12. As will be appreciated, the second cutting blade 30 can include similar interference projections that effectively engage the opposite exterior surfaces of the ferrule to retain the second cutting blade in the deployed mode and/or the retracted mode.

The first interference projection 26P can be in the form of a first tab that projects at least partially through the first plane 1P generally outward from the side surface 24 of the blade. Likewise, the second interference projection 36 of the second cutting blade can be in the form of a second tab that projects away from the first plane and/or the second plane when the first cutting blade and second cutting blade are adjacent one another within the slot.

In use, the broadhead 10 is configured so the first and second cutting blades are adapted to pivot or rotate from a retracted mode to a deployed mode, for example as shown in FIGS. 1 and 2, respectively. In the retracted mode, as mentioned above, the method can include engaging the interference projections and/or tabs of the respective cutting blades 20 and 30 against second 42 and first 41 exterior surfaces of the ferrule, respectively, to hold those blades in the retracted mode. When the broadhead 10 penetrates the target, the first and second lever arms 25 and 35 are used to rotate the blades 20 and 30 outward from the longitudinal axis LA generally about the pin 52 or an associated axis of rotation. Initially, the interference projections of the respective blades come to disengage the respective exterior surfaces of the ferrule so that the respective retention arms move through the slot from a first side to a second side and/or vice versa depending on the blade. After the blades have been fully deployed, the respective interference projections of the first cutting blade 20 and second cutting blade 30 engage the respective exterior surfaces 41 and 42 of the ferrule to hold the blades in the deployed mode, as shown for example in FIGS. 2, 14 and 15.

Figure 16:
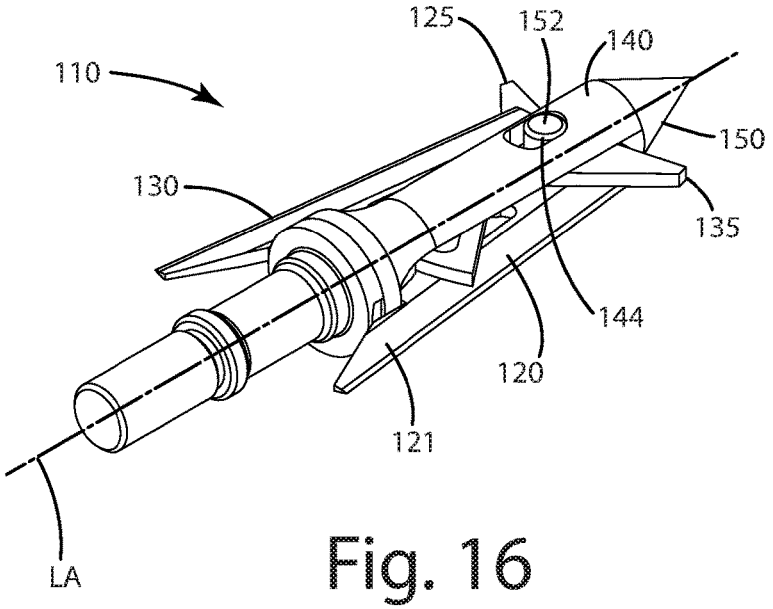
FIG. 16 is a perspective view of a broadhead of a first alternative embodiment with cutting blades thereof in a retracted mode.
Figure 17:
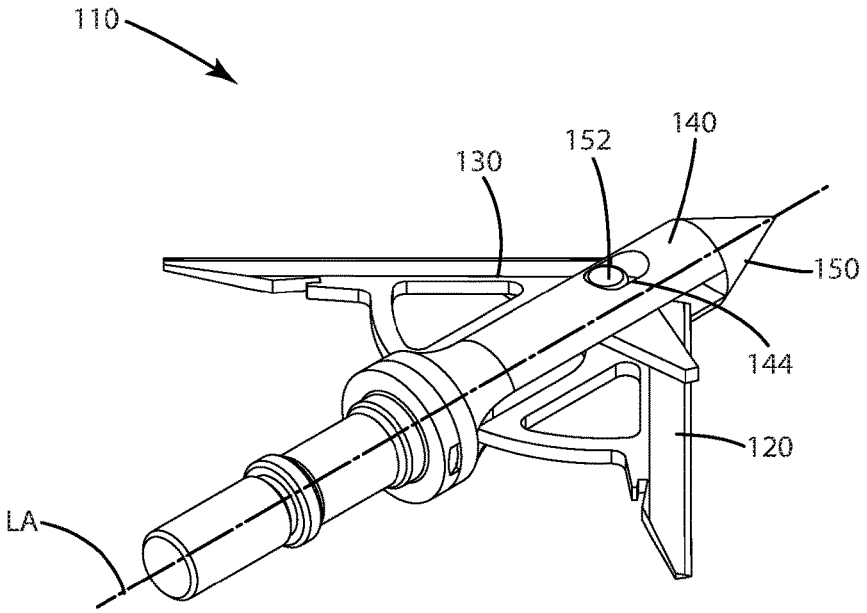
FIG. 17 is a perspective view of the broadhead with the cutting blades thereof in a deployed mode.
Figure 18:
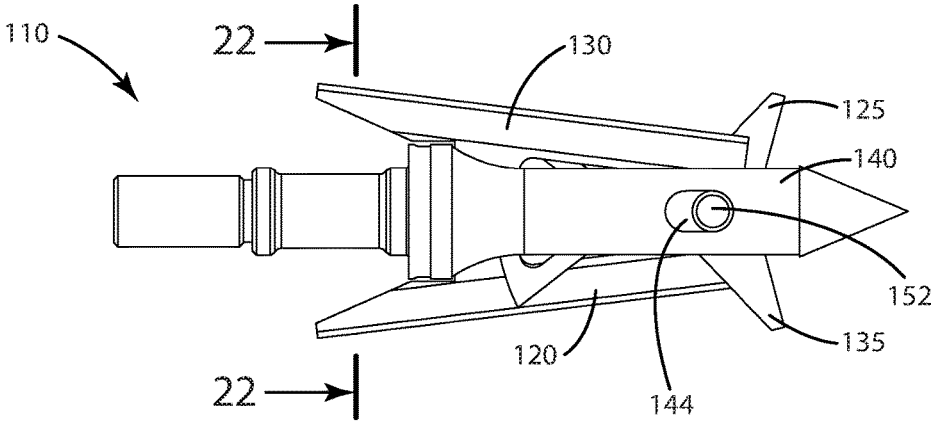
FIG. 18 is a top view of the broadhead with the cutting blades thereof in a retracted mode.
Figure 19:
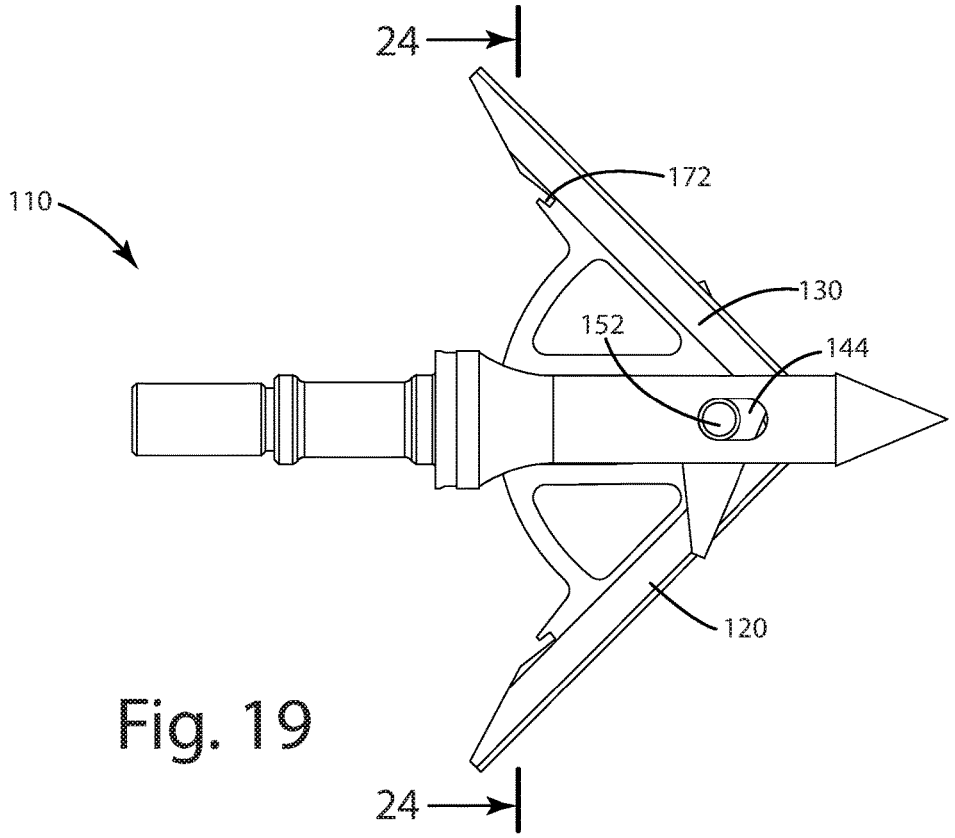
FIG. 19 is a top view of the broadhead with the cutting blades thereof in a deployed mode.

A first alternative embodiment of the broadhead is illustrated in FIGS. 16-27 and generally designated 110. This embodiment is similar in structure, function and operation to the embodiment described above, with several exceptions. For example, this embodiment includes a ferrule 140 to which first and second cutting blades 120 and 130 are moveably and pivotably joined. The cutting blades of this embodiment can be joined via a pin 152 to the ferrule 140. The pin 152 can be registered in a pin slot 144. This pin slot can be elongated and can extend along a distance of the longitudinal axis LA. The pin can be configured to slide or otherwise move within the slot 144 from a first position adjacent the tip 150 as shown in FIG. 16 to a second position that is more distal from the tip 150 as shown in FIG. 17 within that slot. Generally, the pin 152 can be considered to be slidable within the pin slot 144. In turn, this allows the respective cutting blades 120 and 130 to both pivot and/or rotate about the pin 152, optionally simultaneously, with movement backward, slightly away from the tip 150 upon deployment. The pin slot 144, as mentioned above, can be an elongated slot extending generally parallel to the longitudinal axis LA. The pin slot itself can intersect the longitudinal slot 160 within which the blades are located. The pin 152 also can extend generally perpendicular to the longitudinal axis and can be slidable within the pin slot, as mentioned above, so that the pin slides along the longitudinal axis or some other reference axis, as the cutting blade transitions from the retracted mode to the deployed mode. Optionally, the cutting blades can be considered to be rotatable and about the pin 152, and simultaneously slidable within the longitudinal slot 160. More generally, the various components of the cutting blade pivot and slide with one another as the cutting blades transition from the retracted mode to the deployed mode.

The first and second cutting blades of this embodiment can include similar features to those of the embodiments described above. For example, the first cutting blade 120 can include a first lever arm 125 disposed on one side of the longitudinal axis and a cutting edge 121 disposed on a second or opposite side.

Like the embodiment above, the first and second cutting blades are each movable from a retracted mode in which their respective cutting edges lie generally adjacent the ferrule, to a deployed mode in which the cutting edge extends generally outward and away from the ferrule. The first and second cutting blades can be guided by the pin within the slot so that at least a portion of the cutting blades move linearly along the longitudinal axis as the cutting blades transition from the retracted mode to the deployed mode. The pin aperture as noted above enables the pin to move with the first cutting blade. The first cutting blade is pivotally and moveably joined with the ferrule in this manner. Optionally, the cutting blade can both rotate relative to the pin and can move along at least a portion of a longitudinal axis or some other axis defined by the ferrule or broadhead upon deployment and/or transition from the retracted mode to the deployed mode.

Figure 22:
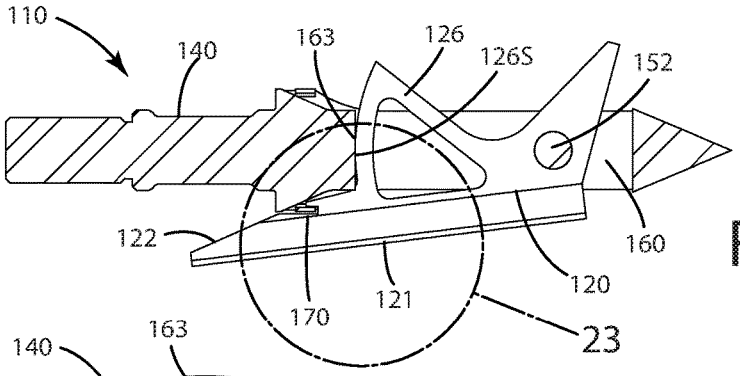
FIG. 22 is a section view of the broadhead with the blades oriented in a retracted mode taken along line 22-22 of FIG. 18.
Figure 23:
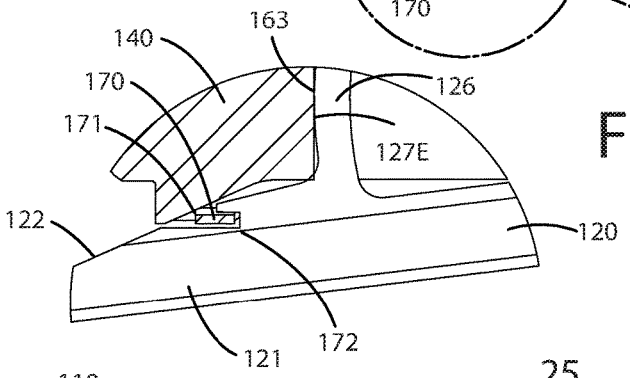
FIG. 23 is a close up of the section view of the broadhead with the blades oriented in a retracted mode taken from FIG. 22.
Figure 24:
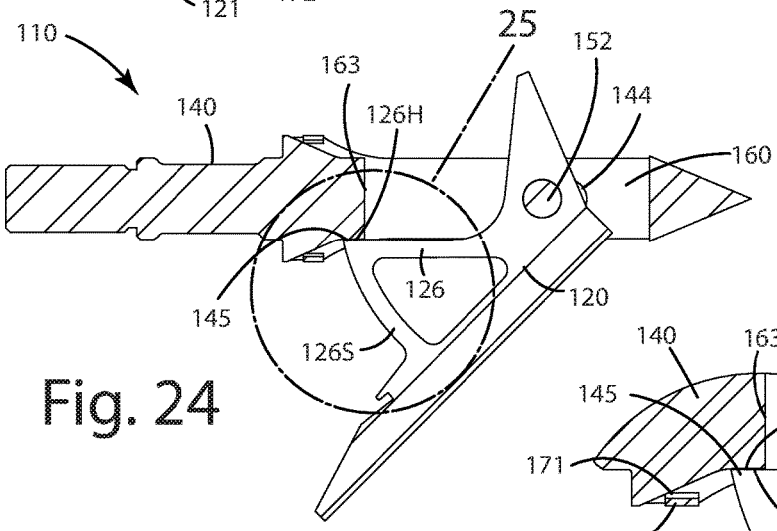
FIG. 24 is a section view of the broadhead with the blades oriented in a deployed mode taken along lines 24-24 of FIG. 19.
Figure 25:
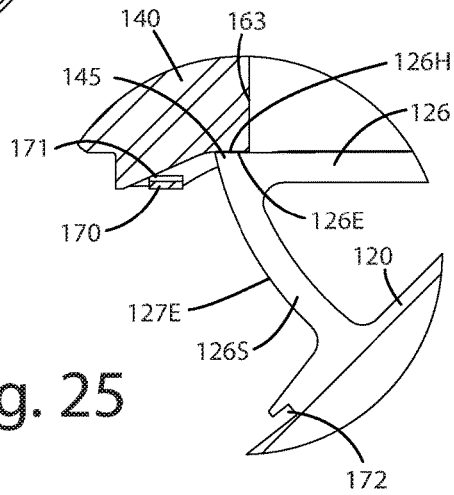
FIG. 25 is a close up view of a retention arm engaging a surface of a ferrule of the broadhead.
Figure 26:
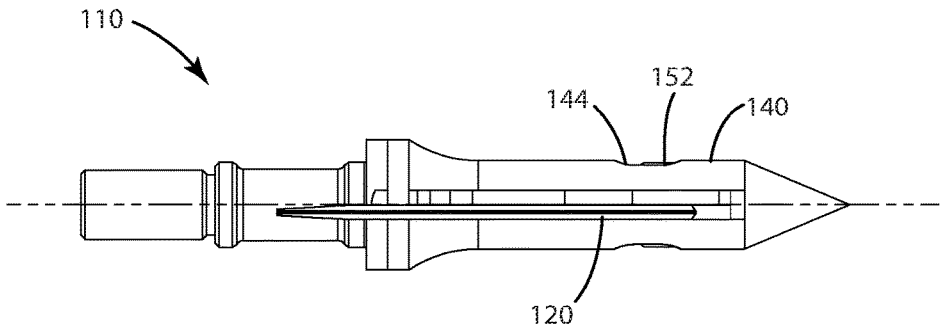
FIG. 26 is a side view of the broadhead with the cutting blades thereof in a retracted mode.
Figure 27:
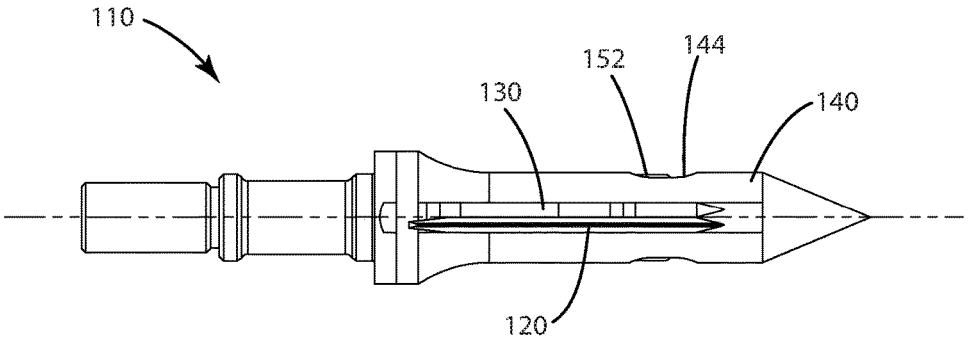
FIG. 27 is a side view of the broadhead with the cutting blades thereof in a deployed mode.
Figure 28:
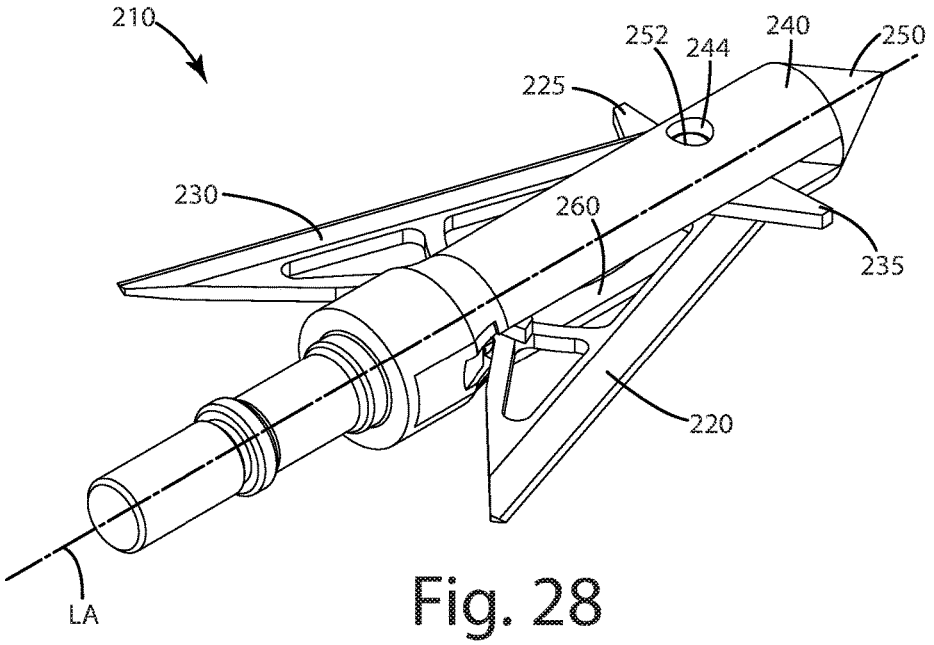
FIG. 28 is a perspective view of a broadhead of a second alternative embodiment with cutting blades thereof in a retracted mode.
Figure 29:
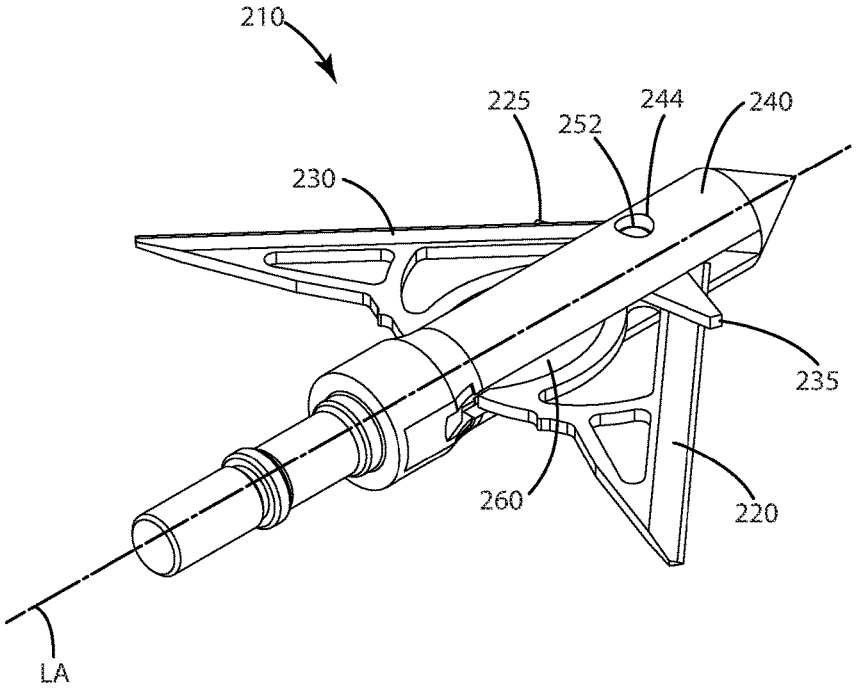
FIG. 29 is a perspective view of the broadhead with the cutting blades thereof in a deployed mode.
Figure 30:
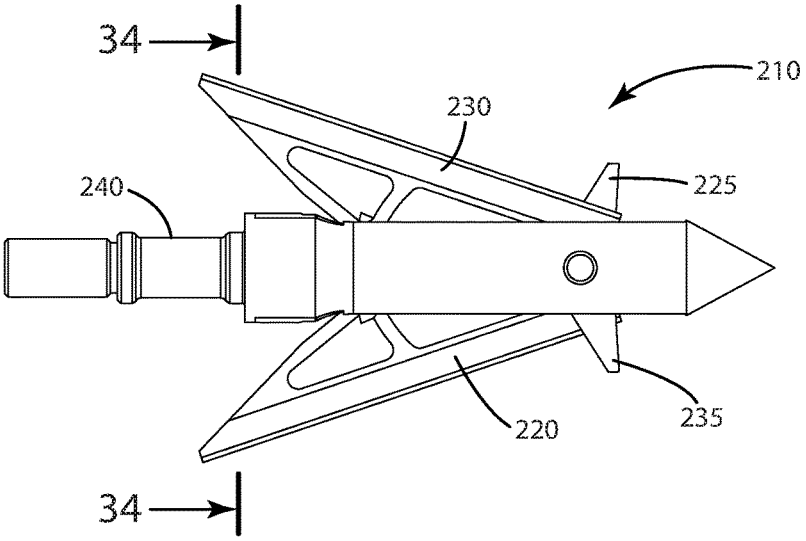
FIG. 30 is a top view of the broadhead with the cutting blades thereof in a retracted mode.
Figure 31:
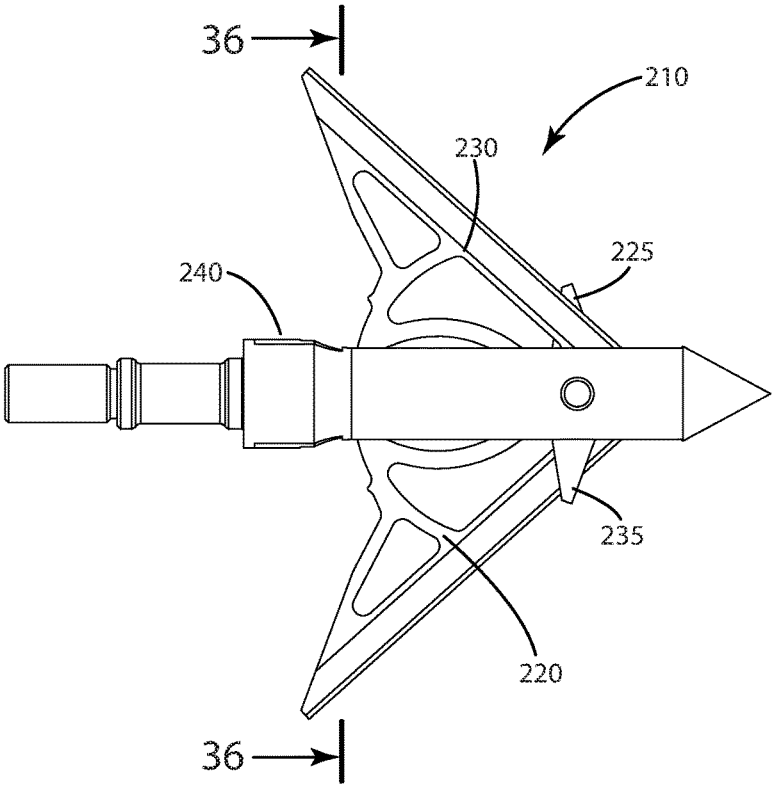
FIG. 31 is a top view of the broadhead with the cutting blades thereof in a deployed mode.

As with the other embodiments, this embodiment can include cutting blades having outer cutting edges, for example 121 of blade 120 and lever retention arms, for example the first retention arm 126 extending from the interior edge 122 of the cutting blade. A first retention arm 126 can include a support portion 126S that engages a portion of the longitudinal slot 160. For example, the support portion 126S can engage the bottom wall 163 of the slot 160 when the first blade 120 is in the retracted mode as shown in FIG. 22. Optionally, the support portion 126S of the first retention arm 126 can include a curvilinear edge, and/or an angled edge that engages the bottom wall 163 of the slot 160 to assist in holding the cutting blades in the retracted mode. The first retention arm 126 also can include a hold-open portion 126H. This hold-open portion 126H can move beyond the bottom wall 163 of the slot 160 when the blades are in the deployed mode, particularly after the blades slide with the pin 152 moving in the longitudinal pin slot 144. As shown in FIG. 24, the hold-open portion 126H engages a shoulder 145 of the ferrule 140 that is adjacent the longitudinal slot 160 in which the blades move and/or rotate. Again, when the hold-open portion 126H engages that shoulder 125, the hold-open portion and the retention arm assist in holding the first cutting blade 120 in the deployed mode. Because the first retention arm 126 is joined with the remainder of the blade, that retention arm pivots and moves with that remainder as the cutting blade transitions from the retracted mode to the deployed mode. Optionally, the hold-open portion 126H can include a contact edge 126E as shown in FIG. 25. This contact edge 126E can engage the shoulder 145 when the broadhead is in the deployed mode. Optionally, the hold-open portion 126H can be configured so that the cutting blade is further rotatable forward relative to the longitudinal axis to provide an anti-barbing effect and to enable game to remove the broadhead in some cases. The support portion 126S also can include a support edge 127E that is adjacent and contiguous with the contact edge 126E of the hold-open portion 126H. The support edge 127E can engage the bottom wall 163 of the longitudinal slot when the broadhead is in the retracted mode. The contact edge can also be disposed at an opposite side of the ferrule from the cutting edge when the first cutting blade is in the retracted mode.

Figure 20:
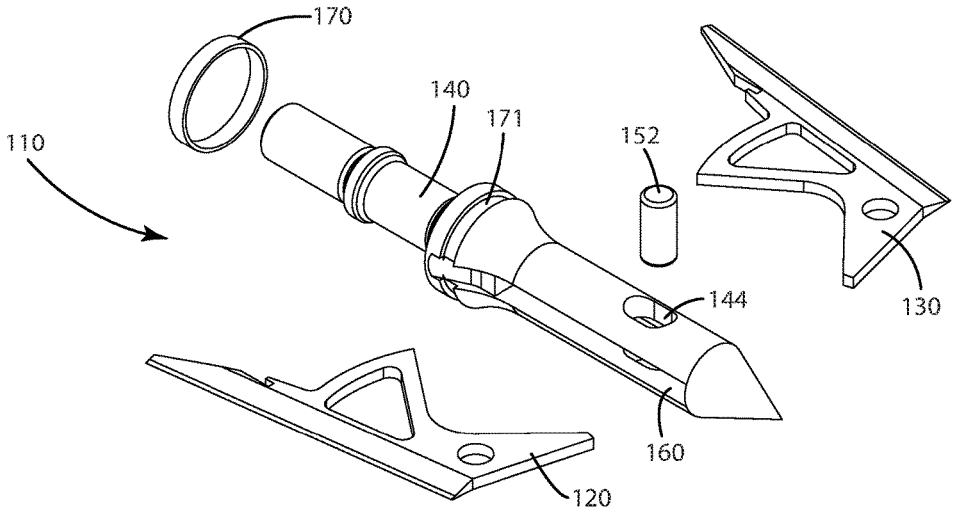
FIG. 20 is an exploded view of the broadhead with the blades oriented in a retracted mode.
Figure 21:
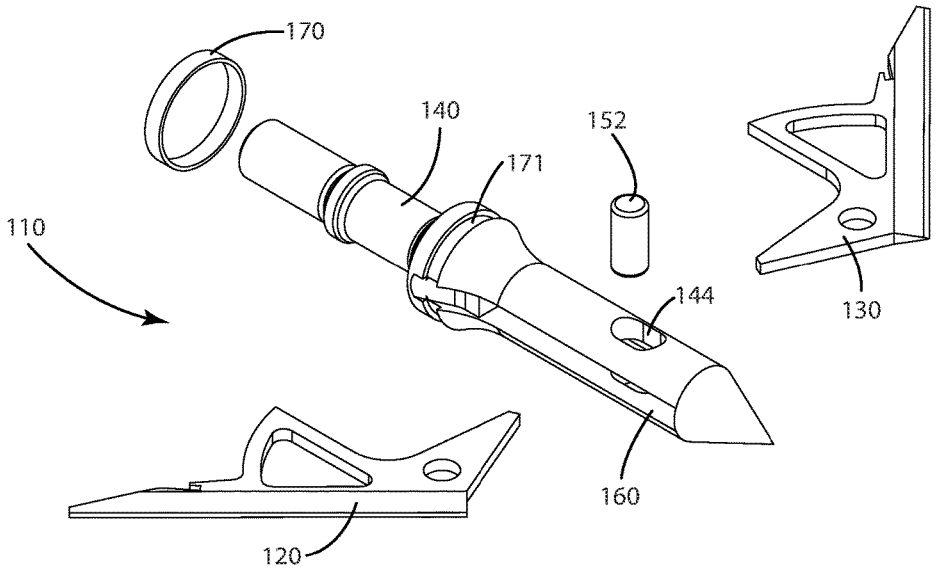
FIG. 21 is an exploded view of the broadhead with the blades oriented in a deployed mode.

To assist in holding the blades in the retracted mode, this embodiment optionally can include a collar 170 that at least partially wraps around the ferrule 140. The collar 170 is shown in FIGS. 20, 21, as well as FIGS. 23 and 25. The collar can be constructed from a variety of materials, for example a metal material, a polymeric material and an elastomeric material. Optionally, the collar can extend 360° around the ferrule. In some cases, where metals or polymers are used, the collar can be discontinuous, with a gap formed between respective ends of the collar. The collar 170 can be at least partially disposed in a first recess 171 defined by the ferrule 140. This recess 171 can locate the collar 170 in a pre-desired location relative to the cutting blade 120 and in particular the interior edge 122 of the cutting blade. In some cases, the interior edge 122 can further define its own collar recess 172. This collar recess 172 can be generally aligned with the first collar recess 171. The collar 170 itself can be disposed within the first collar recess 171 and the second collar recess of the cutting blade simultaneously in the retracted mode to assist in holding the first cutting blade in the retracted mode. The collar 170 can also be configured so that it exits the collar recess 172 of the first cutting blade 120 as the first cutting blade transitions from the retracted mode to the deployed mode.

Optionally, the collar 170 can be slightly deformable so that it can easily exit the collar recess 172 and enable the cutting blades to deploy. The collar itself can be made from a low friction material to facilitate movement between it and the collar recess and/or cutting blade in general.

A second alternative embodiment of the broadhead is illustrated in FIGS. 28-39 and generally designated 210. This embodiment is similar in structure, function and operation as the embodiments described above with several exceptions. For example, this embodiment can include a ferrule 240 that terminates at a penetrating tip 250. The ferrule can define a longitudinal slot 260 as described in the embodiments above. First 220 and second 230 cutting blades can be individually disposed within the longitudinal slot 260. These blades can pivot or rotate about a pin 252 or some axis that is disposed in a pin aperture 244 defined by the ferrule. This pin aperture can be similar to any of the pin apertures described above. The cutting blades can include respective lever arms. For example, first cutting blade 220 can include a first lever arm 225, and the second cutting blade 230 can include a second lever arm 235.

As shown in FIGS. 34-37, longitudinal slot 260 can define a bottom wall 263. The bottom wall at a portion of the ferrule 240 can include or can otherwise be joined with one or more plungers 270, 280. These plungers may be slidably disposed in respective plunger bores 271 and 281, respectively. The plungers can be joined with or can include a biasing element 272 and 282. The biasing elements for the respective plungers can be in the form of coil springs. Of course, the biasing elements can take on other forms. As an example, the plungers can be joined with an elastomeric and/or resilient member that can compress and expand with memory to provide a desired biasing effect. Indeed in some cases, the plungers themselves can be constructed entirely from this elastomeric material to provide the desired effects of holding the blades in the retracted mode and/or deployed mode. In other cases, the biasing elements 272 and 282 can be constructed from leaf springs, magnetic elements, or other similar mechanisms to enable the plungers 270 and 280 to move relative to the bores 271 and 281 and more generally to the respective cutting blades 220 and 230.

Optionally, although shown with two plungers, this embodiment of the broadhead can be constructed so as to include only a single plunger and/or more than two plungers, depending on the particular application and the desired movement of the respective blades.

Figure 35:
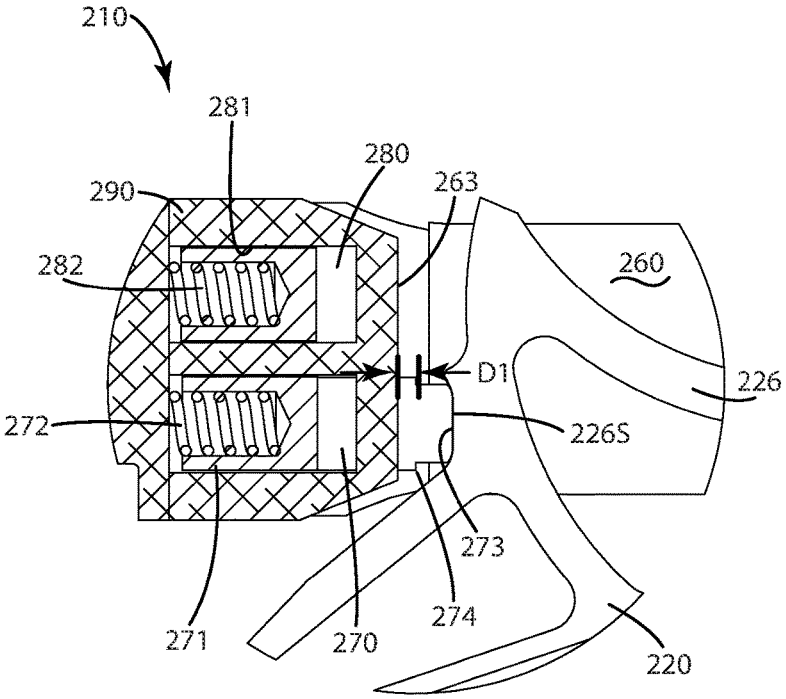
FIG. 35 is a close up of the section view of the broadhead with the blades oriented in a retracted mode taken from FIG. 34.
Figure 37:
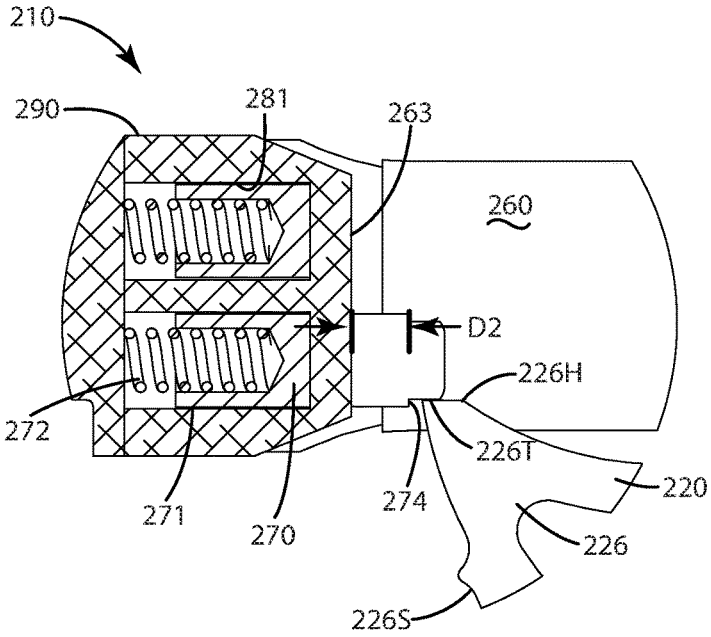
FIG. 37 is a close up view of a plunger engaging an exterior surface of a ferrule of the broadhead.
Figure 38:
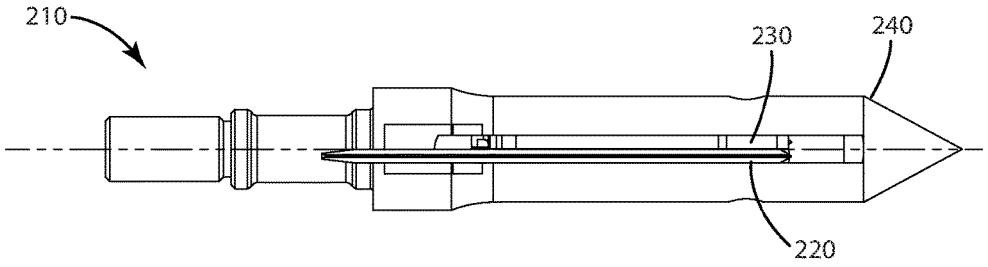
FIG. 38 is a side view of the broadhead with the cutting blades thereof in a retracted mode.
Figure 39:
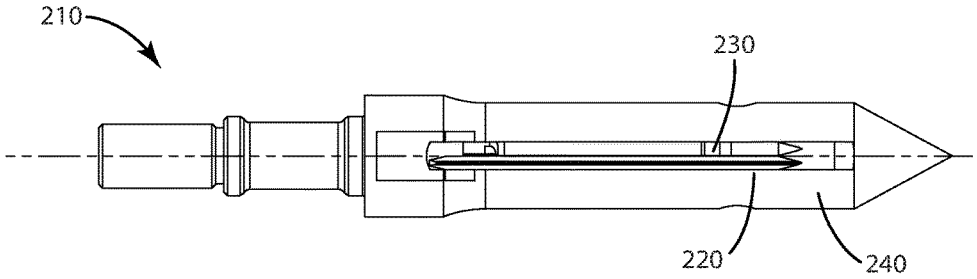
FIG. 39 is a side view of the broadhead with the cutting blades thereof in a deployed mode.
Figure 40:
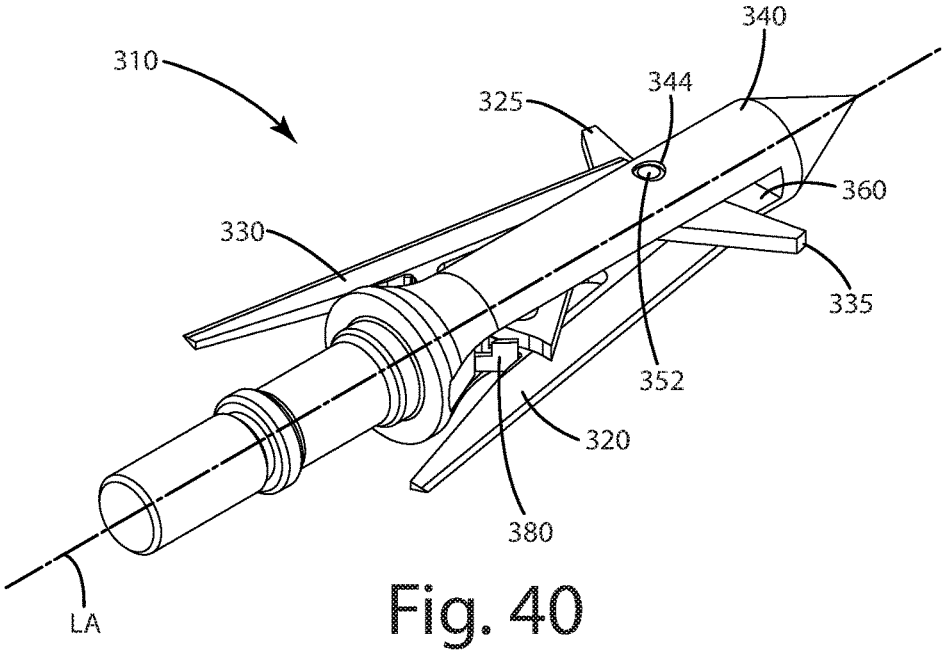
FIG. 40 is a perspective view of a broadhead of a third alternative embodiment with cutting blades thereof in a retracted mode.
Figure 41:
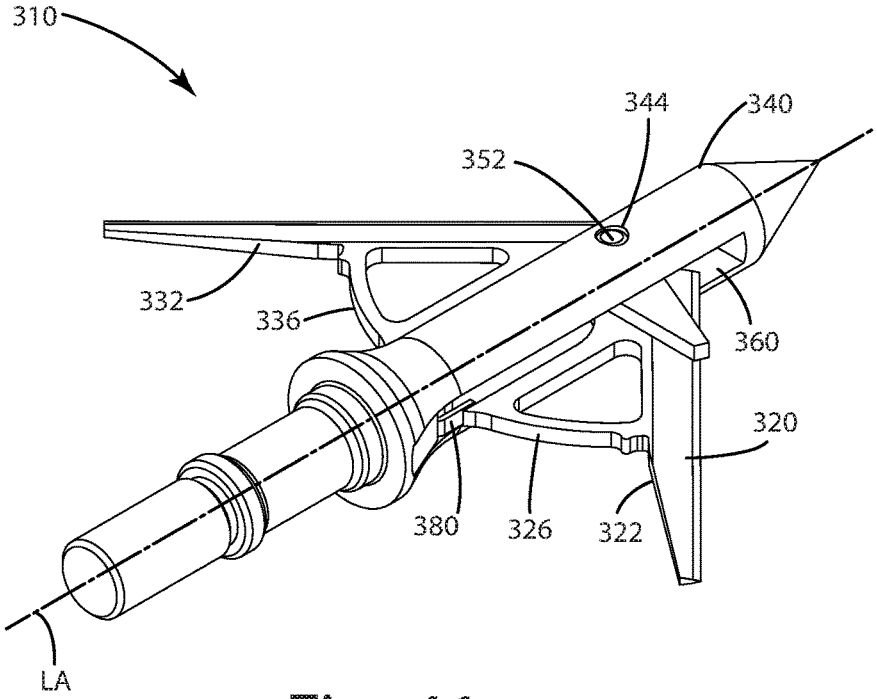
FIG. 41 is a perspective view of the broadhead with the cutting blades thereof in a deployed mode.
Figure 42:
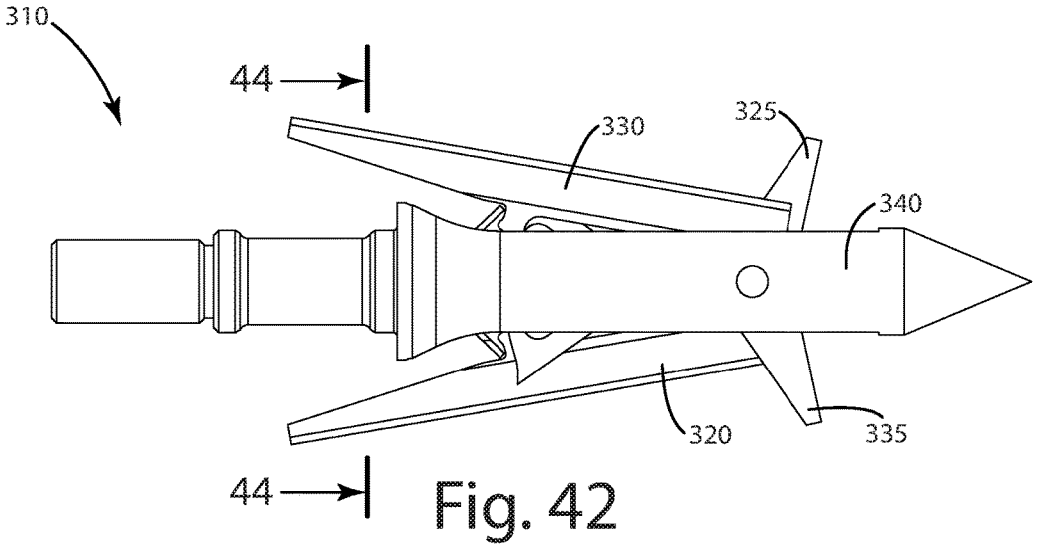
FIG. 42 is a top view of the broadhead with the cutting blades thereof in a retracted mode.
Figure 43:
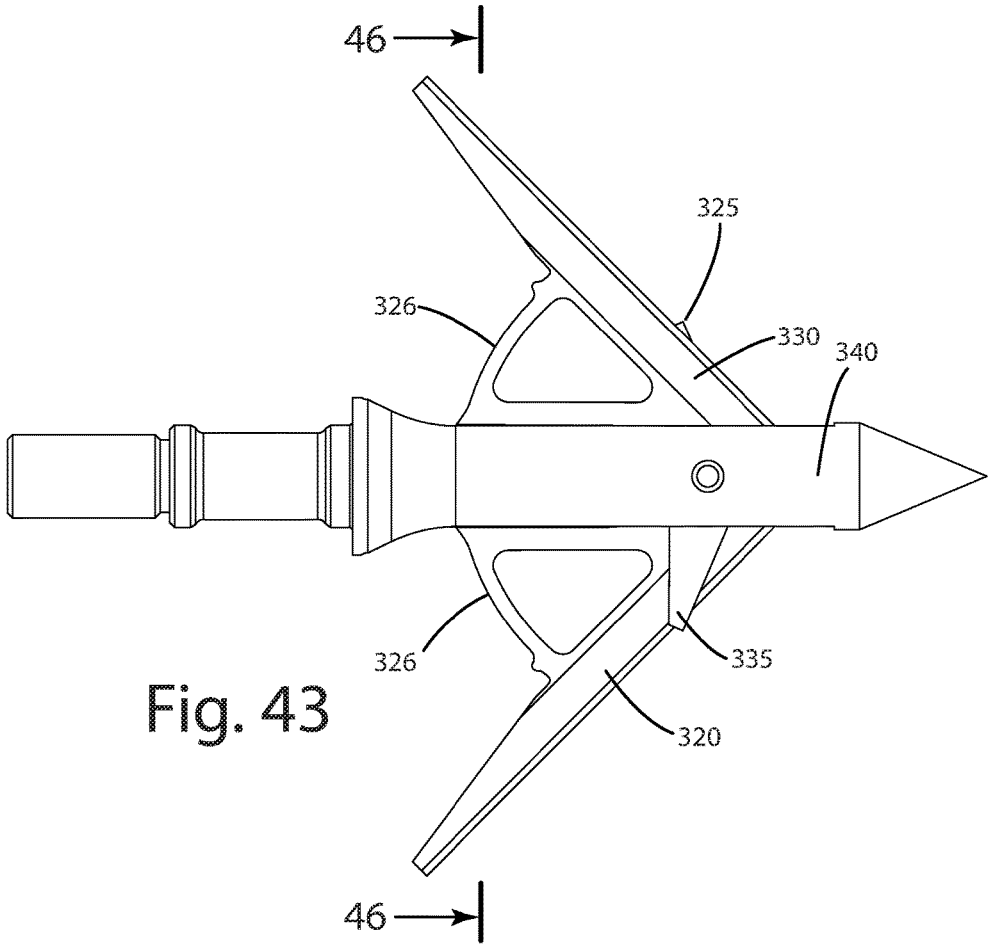
FIG. 43 is a top view of the broadhead with the cutting blades thereof in a deployed mode.
Figure 44:
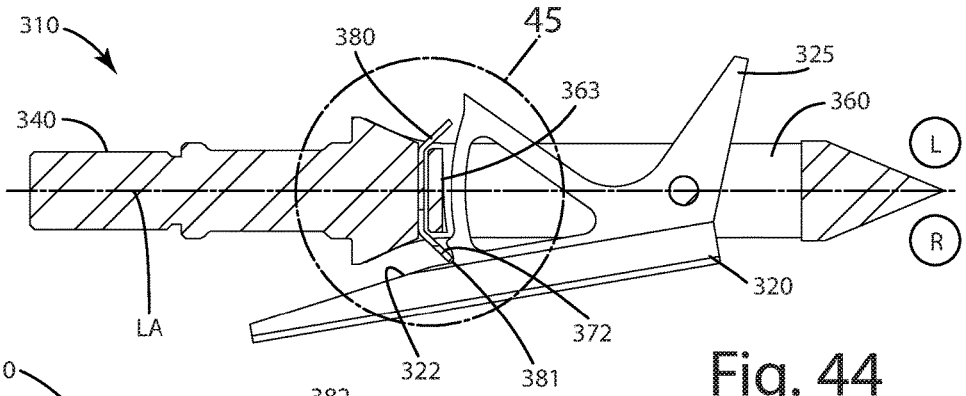
FIG. 44 is a section view of the broadhead with the blades oriented in a retracted mode taken along line 44-44 of FIG. 42.
Figure 45:
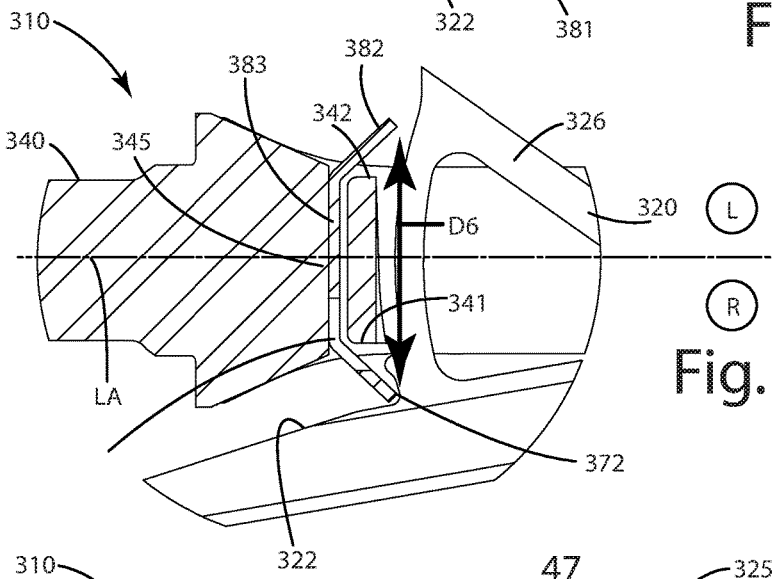
FIG. 45 is a close up of the section view of the broadhead with the blades oriented in a retracted mode taken from FIG. 44.

As shown in FIGS. 35 and 37, the plungers can include a top surface, for example top surface 273 of the first plunger 270. Adjacent the top surface but distal therefrom, the plunger can further include a shoulder 274 or other surface contour such as a recess or projection. The plungers can be configured to move relative to the bottom wall 263 from a distance of D1 from the bottom wall to a distance of D2 from the bottom wall depending on whether the plunger is operating to engage the support portion 226S or the hold-open portion 226H of the retention arm 226 of the cutting blade 220. As with the other embodiments, the first and second cutting blades can be generally identical and can include all of the same components and structure.

Figure 34:
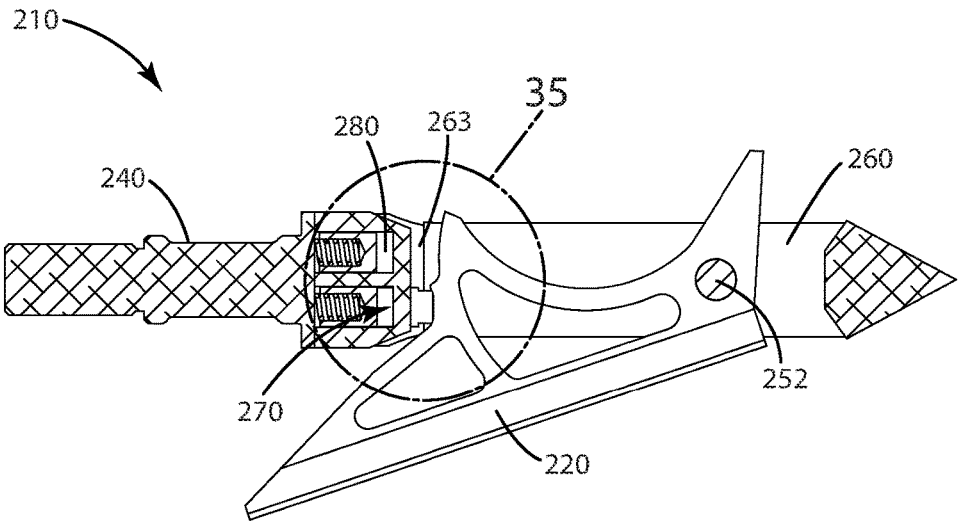
FIG. 34 is a section view of the broadhead with the blades oriented in a retracted mode taken along line 34-34 of FIG. 30.

As shown in FIG. 34, the blades are held in the retracted mode in flight via the plunger 270. In particular, the plunger top surface 273 engages a notch or recess that forms the support portion 226S of the retention arm 226 of the blade 220. Optionally, although shown as being a generally flat and planar surface, the top of the plunger 273, and the notch or recess that forms the support portion 226S can be rounded, curvilinear, linear or of any other contour that can mate with one another and hold the blades closed in the retracted mode. Generally, the support portion 226S can engage a first portion of the plunger, for example the top surface, when the respective cutting blades are in their retracted mode, but does not engage the first portion of the plunger for example the top surface, when the first cutting blade is in the deployed mode. Further, the hold-open portion 226H can engage the shoulder or some other second portion of the plunger when the cutting blades are in the deployed mode but does not engage the second portion of the plunger, for example the shoulder when the cutting blades are in the retracted mode.

Figure 36:
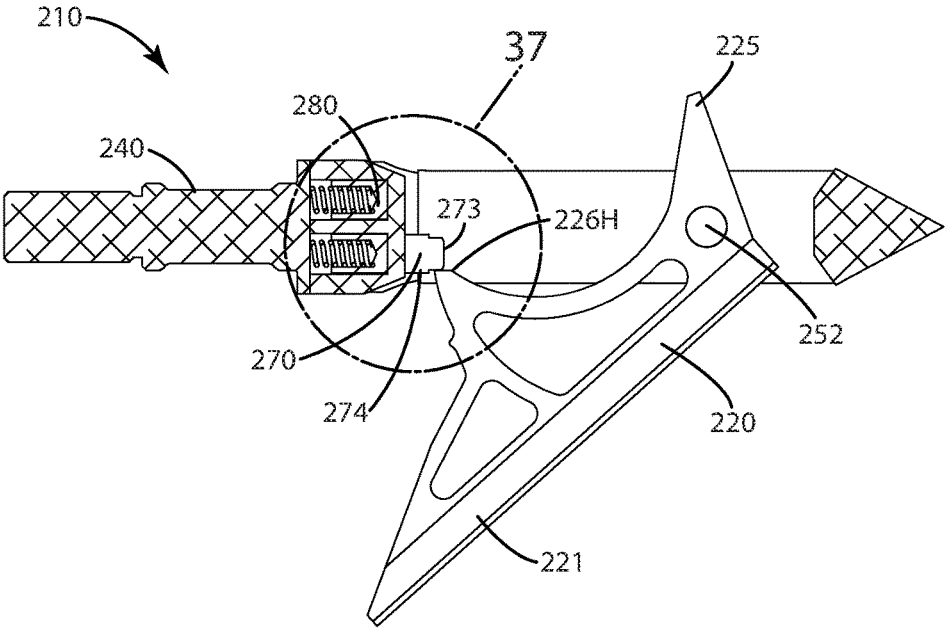
FIG. 36 is a section view of the broadhead with the blades oriented in a deployed mode taken along lines 36-36 of FIG. 31.

On impact with a target, each lever arm of the respective blades, for example the lever arm 225 of the first cutting blade 220 as shown in FIG. 36, causes the blade to pivot about the pin 252. In turn, the cutting edge of the blade swings outward away from the ferrule. The plunger, and in particular, the top surface 273, slides or moves relative to the support portion 226S because the forces generated by the pivoting blade are greater than the forces generated by the biasing element 272 to push the plunger against the blade and hold the cutting blade in the retracted mode. Accordingly, the blade swings open farther until the hold-open portion 226H of the cutting blade 220 engages the plunger 270. Optionally, a tip 226T of the hold-open portion 226H can fit within or adjacent a shoulder 274, of the plunger 271 to thereby temporarily hold the blade in the deployed mode, for example, as the blade passes through a target. As the blade rotates and the different portions of the retention arm engage the plunger, the plunger 270 extends from a first distance D1 to a second distance D2, which is greater than distance D1, from the bottom wall 263 of the longitudinal slot 260. This movement can be facilitated by the biasing element 272 associated with the plunger. Optionally, the shoulder 274 and tip 226T can be configured so that the hold-open portion 226H is not effectively locked in place relative to the plunger 271. Accordingly, this provides an anti-barbing effect, and enables the blades and in particular the cutting edges to swing forward to allow the broadhead to be removed by game.

Optionally, the hold-open portion 226H of the cutting blade can include a contact edge. A second portion of the plunger, for example the shoulder, can engage that contact edge of the cutting blade when the cutting blade is in the deployed mode.

Figure 32:
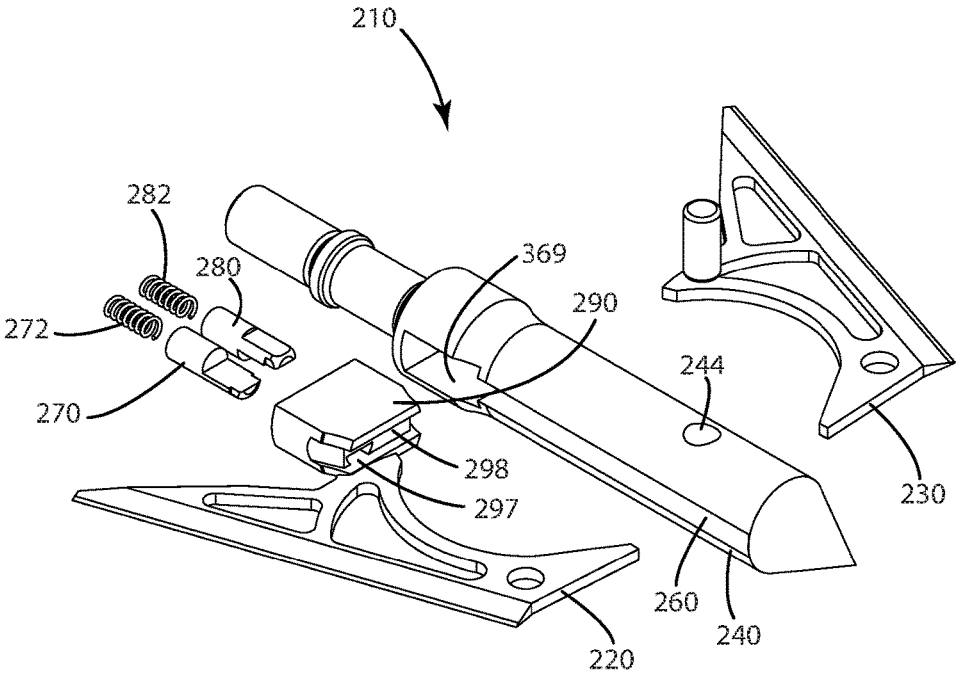
FIG. 32 is an exploded view of the broadhead with the blades oriented in a retracted mode.
Figure 33:
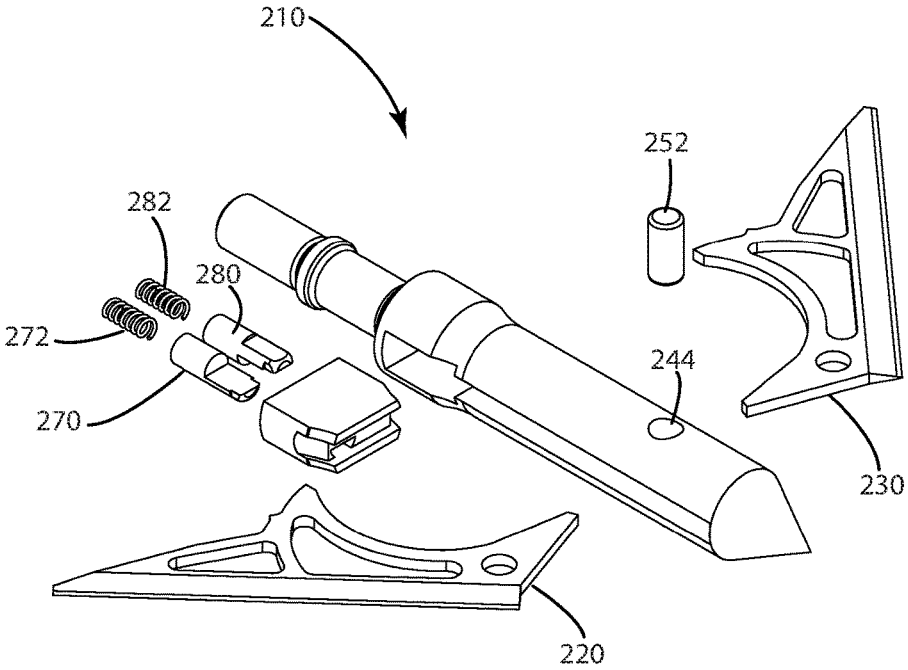
FIG. 33 is an exploded view of the broadhead with the blades oriented in a deployed mode.

Further optionally, the plungers 270 and 280 can be mounted in a plunger housing 290, as shown in FIGS. 32 and 35. The plunger housing 290 itself can be selectively and optionally replaceably mounted in a plunger housing recess or slot 269 that is contiguous with the longitudinal slot 260 within which the blades are mounted. The plunger housing 290 can include respective plunger recesses 297 and 298 within which the plungers 270 and 280 can move. The plunger housing 290 also can define the respective bores 271 and 281 within which the plungers move. With the optional plunger housing, this component along with the respective plungers and biasing elements can be periodically replaced and/or serviced relatively easily. The housing itself can be friction-fit or secured with fasteners (not shown) in the housing recess.

A third alternative embodiment of the broadhead is illustrated in FIGS. 40-49 and generally designated 310. This embodiment is similar in structure, function and operation to the embodiments described above, with several exceptions. For example, this embodiment of the broadhead 310 includes a ferrule 340 that defines a longitudinal slot 360 within which the respective blades 320 and 330 pivot or rotate from a retracted mode showing FIG. 40 to a deployed mode showing FIG. 41. As with the other embodiments, the respective blades can be mounted via a pin 352 positioned in a pin aperture 344. The blades themselves can include respective lever arms 325 and 335 that assist in the deployment from the retracted mode to the deployed mode as with the embodiments above. In this embodiment, the blades include respective retention arms 326 and 336 that extend inward from an interior edge 322 and 332 of the respective blades. These retention arms can interact with a biasing element 380 to hold the blades in either the retracted mode or the deployed mode as further described below.

In particular, the biasing element 380 can be in the form of a selectively deformable strip of material, optionally in a U-shape. This material can be a polymeric material, a composite and/or a metal or other comparable materials. Generally, the biasing element 380 can selectively deform when the first and second lever arms of the respective first and second blades initiate rotation of the first cutting blade 320 and second cutting blade 330. In turn, this enables the first and second cutting blades to transition from the retracted mode to the deployed mode. The biasing element 380 also can serve another purpose and can engage the retention arms of the blades in a different location to assist in retaining the first and second cutting blades in the deployed mode.

More particularly, referring to FIGS. 44-47, the biasing element 380 can include a first tip 381 that is configured to engage an interior edge 322 of the cutting blade 320. Likewise, a second tip 382 can engage the interior edge of the second blade. The first tip 381 can the second tip 382 can be joined with a central portion 383. This central portion 383 can be integrally formed with the first and second tips. The central portion can extend through at least a part of the ferrule, for example a cross slot 345 that is defined in the ferrule optionally below the bottom wall 363 of the longitudinal slot 360.

Figure 46:
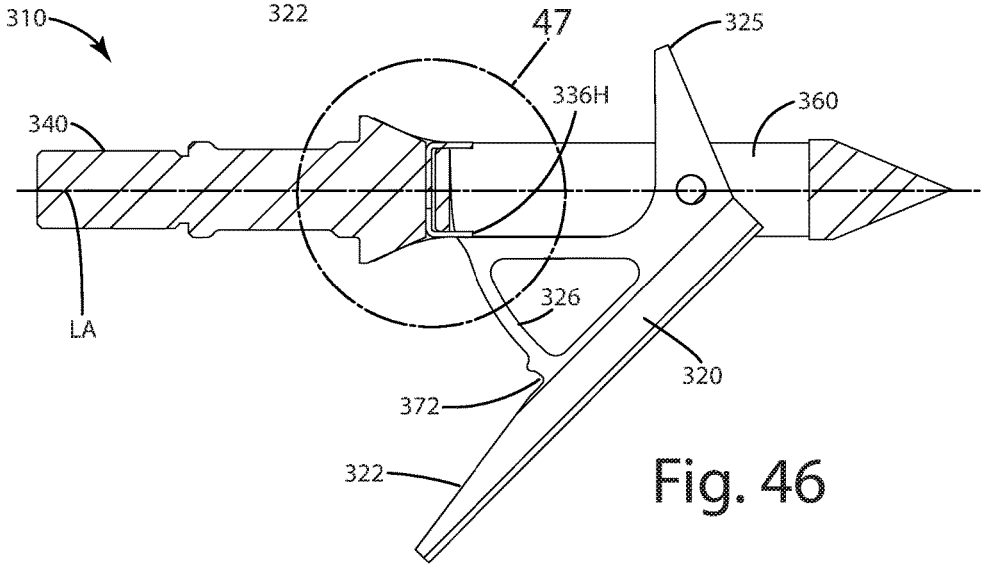
FIG. 46 is a section view of the broadhead with the blades oriented in a deployed mode taken along lines 46-46 of FIG. 43.
Figure 47:
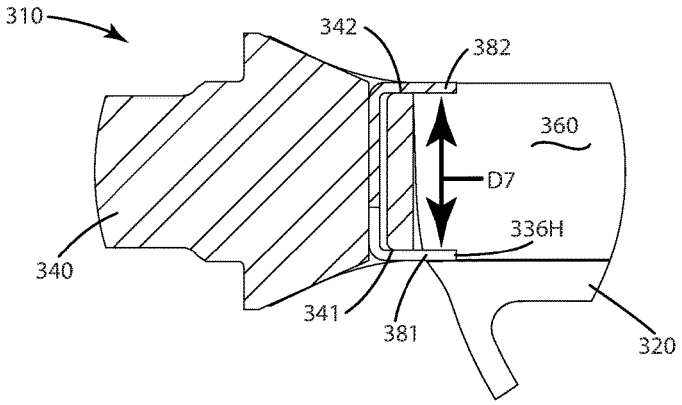
FIG. 47 is a close up view of a biasing member engaging a retention arm of the cutting blade.
Figure 48:
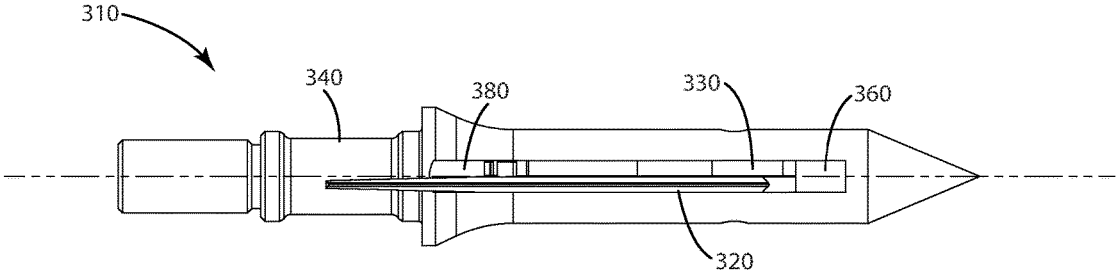
FIG. 48 is a side view of the broadhead with the cutting blades thereof in a retracted mode.
Figure 49:
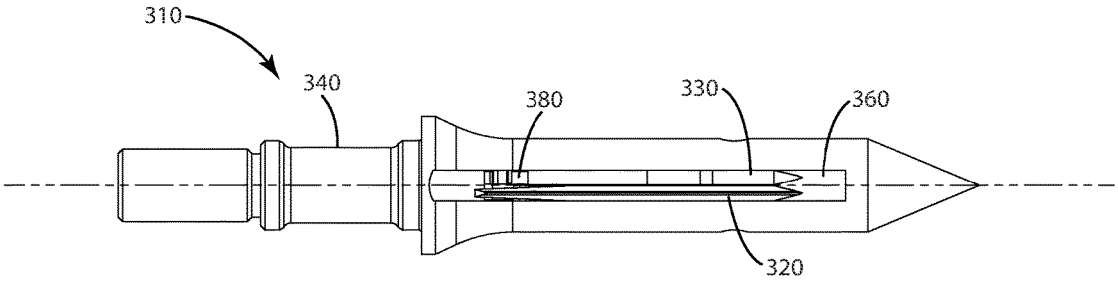
FIG. 49 is a side view of the broadhead with the cutting blades thereof in a deployed mode.
Figure 50:
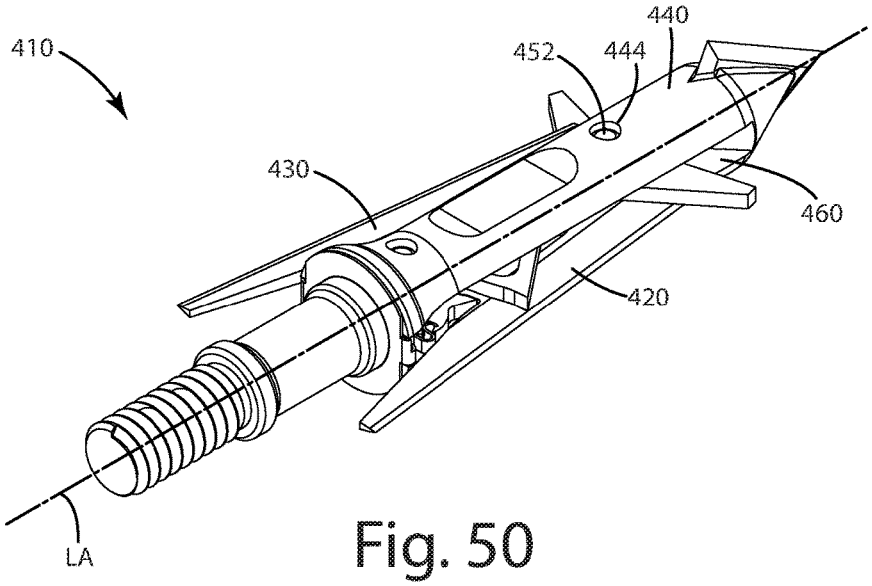
FIG. 50 is a perspective view of a broadhead of a fourth alternative embodiment with cutting blades thereof in a retracted mode.
Figure 51:
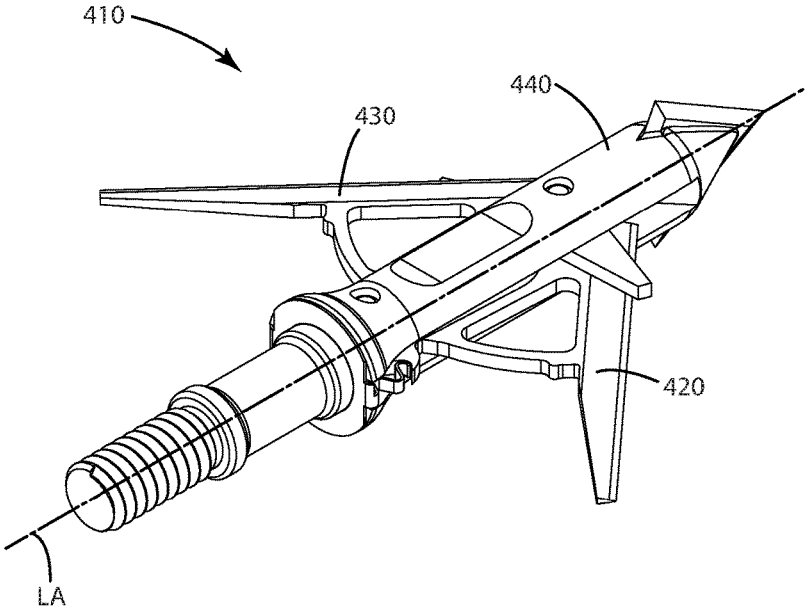
FIG. 51 is a perspective view of the broadhead with the cutting blades thereof in a deployed mode.
Figure 52:
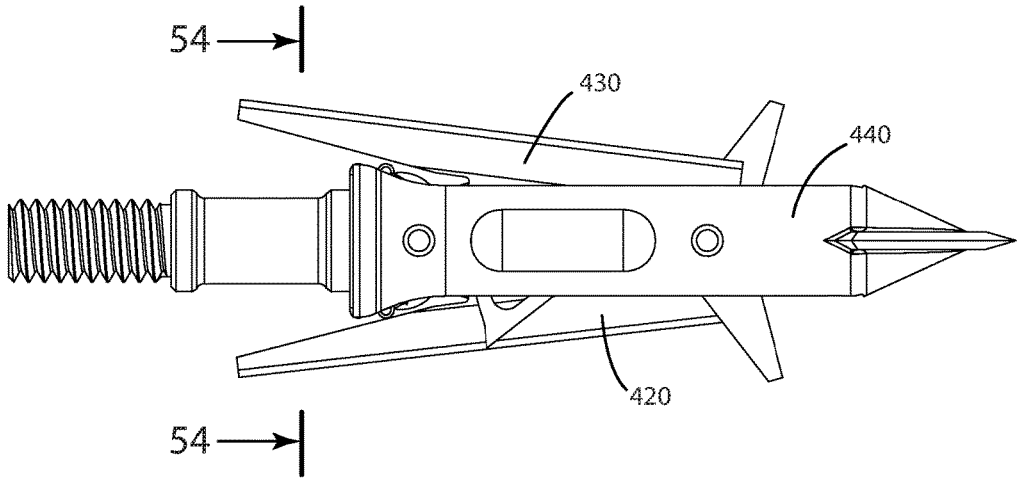
FIG. 52 is a top view of the broadhead with the cutting blades thereof in a retracted mode.
Figure 53:
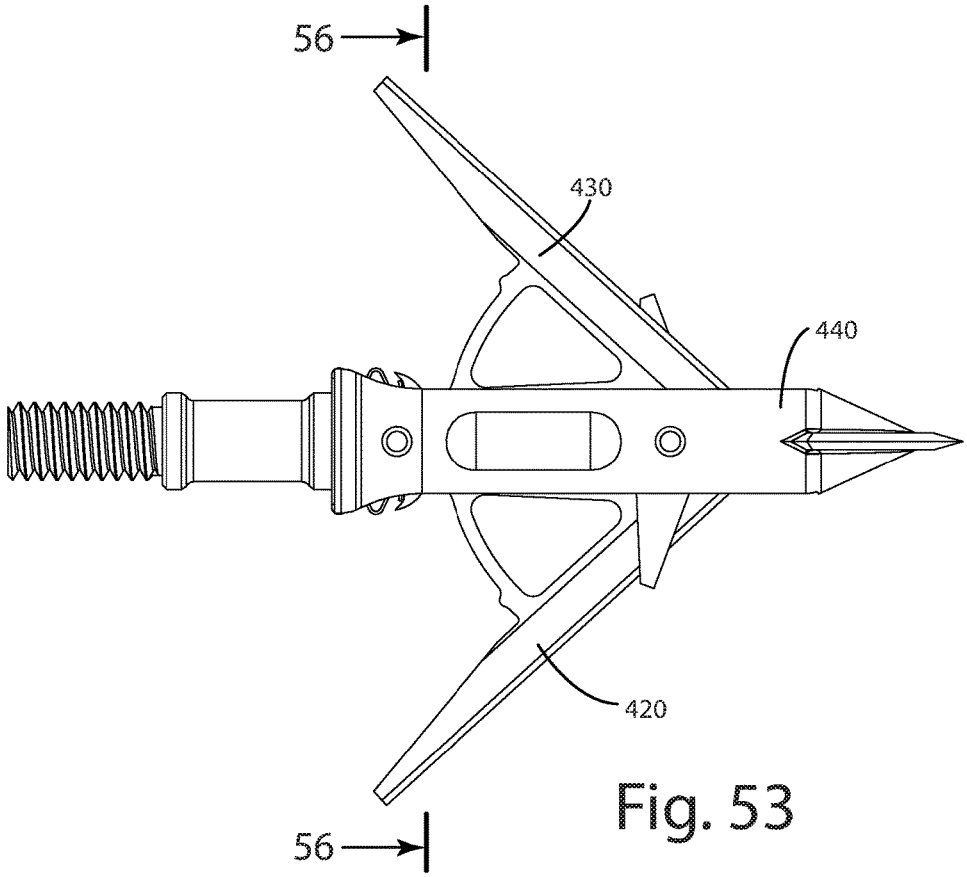
FIG. 53 is a top view of the broadhead with the cutting blades thereof in a deployed mode.
Figure 54:
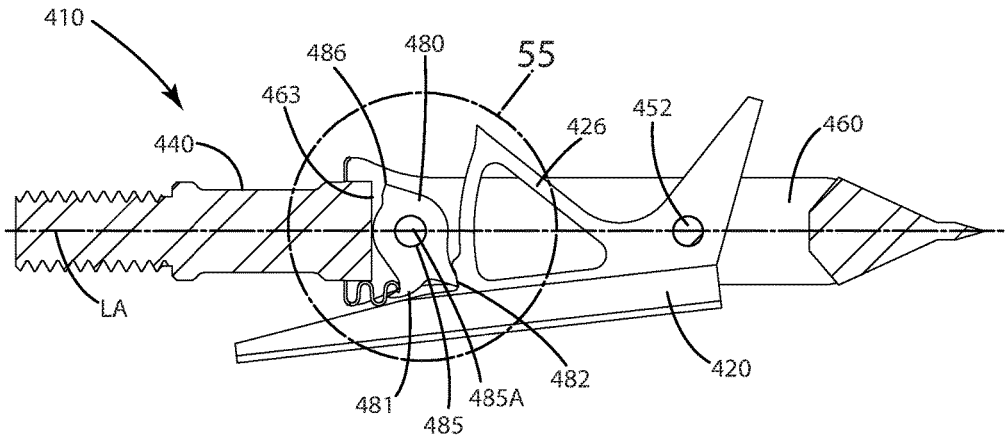
FIG. 54 is a section view of the broadhead with the blades oriented in a retracted mode taken along line 54-54 of FIG. 52.

The first tip 381 and the second tip 382 are movably disposed on respective first R and second L sides of the longitudinal axis LA. Each of the first and second tips are moveable from a first position in which the first tip and second tip extend outwardly from the ferrule 340 when the cutting blades are in the retracted mode. The first 381 and second 382 tips are also moveable from that first position, generally shown in FIGS. 44-45 to a second position as shown in FIGS. 46 and 47. There, each of the respective first and second tips 381 and 382 are adjacent the longitudinal slot 360 or are closer to the exterior side surfaces of the ferrule. In the configuration shown in FIGS. 44 and 45, the biasing element 380 can be in a deformed or tensioned mode. Due to the configuration of the biasing element, it is resiliently deformed and is configured to return to a static mode as shown for example in FIG. 47.

The first and second tips 381 and 382 can be configured to be disposed a first distance D6 from one another when the blades are in the retracted mode (FIG. 45) to a second distance D7 when the blades are in the deployed mode (FIG. 47).

Optionally, the respective tips of the biasing element engage the notches or recesses 372 defined on the interior edge 322 of the blade 320 to hold the blade in a retracted mode. Again, when the lever arm 325 impacts a target and exerts a rotational force on the cutting blade 320 as shown in comparing FIGS. 44 and 46, the first tip disengages the recess or notch 372 defined on the interior edge of the blade. The retention arm 326 thus slides along the first tip 381 until the hold-open portion 336H passes the tip 381. At this point, the tips 381 and 382 move to a closed or static mode at which point the respective first tip 381 engages the interior surface 341 of the ferrule. Likewise, the second tip 382 engages the second interior surface 342 of the ferrule.

As can be seen in FIG. 47, the biasing element is generally in a static mode. It may or may not exert a tension or force of the respective interior and exterior surfaces 341 and 342. In this mode, the biasing element is in the form of a more pronounced U-shape than the biasing element is in when the blades are in the retracted mode, as shown for example in FIG. 45. While shown there in a generally U-shaped configuration, that configuration is less pronounced than the U-shaped configuration shown in FIG. 47.

Optionally, as mentioned above, the biasing element can be constructed from a resilient material, for example a polymeric material, a composite material and/or a metal material. This can enable the first 381 and second 382 tips to rebound toward one another when the cutting blades transition from the retracted mode to the deployed mode. Further, after the tips rebound toward one another, they obstruct the entrance point for the hold-open portion 336 to re-enter the slot 360. In turn, the blades remain in the deployed mode. It will further be appreciated that because the hold-open portion 336H engages the respective tips, for example 381 and 382, and is not directly attached to those tips, the cutting blades can still pivot forward to provide an anti-barbing effect.

A fourth alternative embodiment of the broadhead is illustrated in FIGS. 50-62 and generally designated 410. This embodiment is similar in structure, function and operation to the embodiments described above, with several exceptions. For example, the broadhead 410 of this embodiment can include a ferrule 440 that defines a longitudinal slot 460 within which first and second cutting blades 420 and 430 can be disposed. These blades can effectively pivot about and/or relative to a pin 452 that is disposed through a pin aperture 444 defined by the ferrule 440. The respective blades can include the cutting edges, interior edges and lever arms as described in connection with the embodiments above.

In this embodiment, the broadhead includes first 470 and second 480 pawls that are pivotally joined with the ferrule, and each dedicated to the respective first 420 and second 430 cutting blades. The pawls can be configured to selectively engage the retention arms in a first pawl position to assist in retaining the cutting blades in the retracted mode, and to selectively engage the retention arms in a second pawl position to assist in retaining the cutting blades in the deployed mode.

Figure 57:
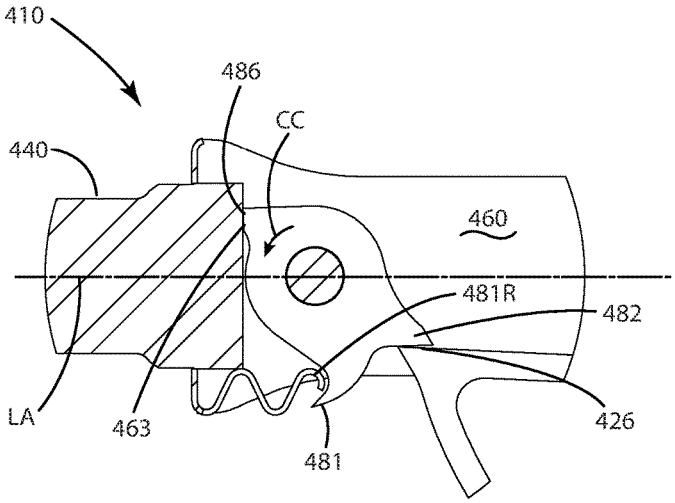
FIG. 57 is a close up view of a biasing member engaging a retention arm of the cutting blade.

As a more particular example shown in FIG. 54-57, the first pawl 480, configured to selectively engage the first cutting blade 420, is mounted within the longitudinal slot 460. The pawl is configured to rotate about and/or relative to a pin 485, which can be parallel to or coincident with a pivot axis 485A of the pawl. This pin 485 can be distal from the pin 452 that joins the respective blades with the ferrule 440. The pawl can be configured to include a pawl stop 486 which is disposed on an opposite side of the pawl axis 485A (and on an opposite side of the longitudinal axis LA) from a first tooth 481 and a second tooth 482 of the pawl. The pawl stop can be configured to engage a bottom wall 463 of the longitudinal slot defined by the ferrule when the first cutting blade is in the deployed mode. This engagement stops or arrests rotation of the pawl further in the counterclockwise CC direction as shown in FIG. 57. This pawl stop 486 can be in the form of a flat planar face or alternatively can be a small projection or lobe that ceases rotation of the pawl, but that still enables the pawl to rotate back in the clockwise direction when the broadhead is reconfigured from the deployed mode to the retracted mode for further use.

As mentioned above and shown in FIGS. 55 and 57, the pawl 480 can include first and second pawl teeth 481 and 482. The first pawl tooth 481 can be a projection from the pawl sufficient to engage a biasing element 472 that is joined with a static portion of the ferrule or otherwise integrally formed with the ferrule. This biasing element can be in the form of a wavy spring with a tip 473 that engages a recess 481R in the lower surface of the tooth 481.

Figure 55:
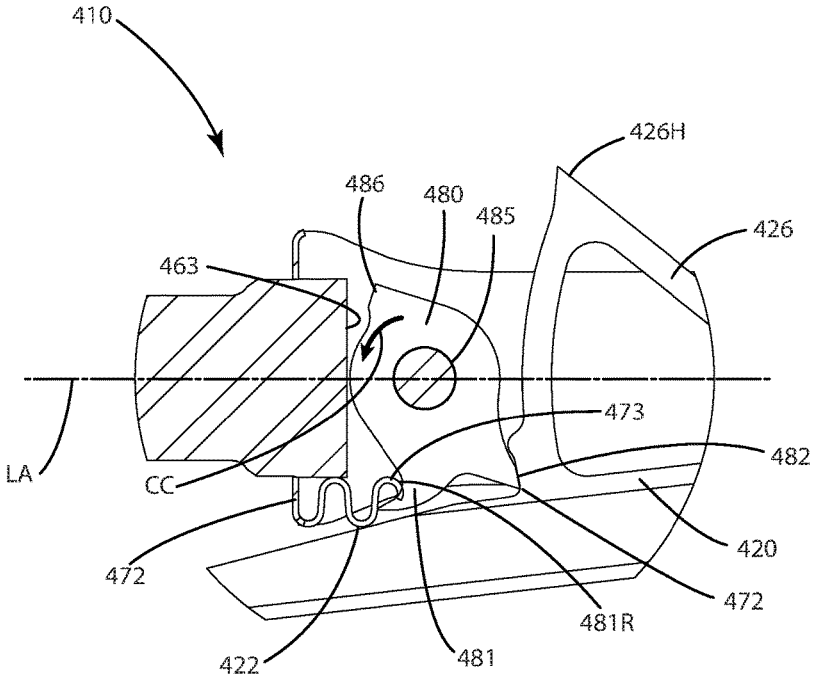
FIG. 55 is a close up of the section view of the broadhead with the blades oriented in a retracted mode taken from FIG. 54.
Figure 56:
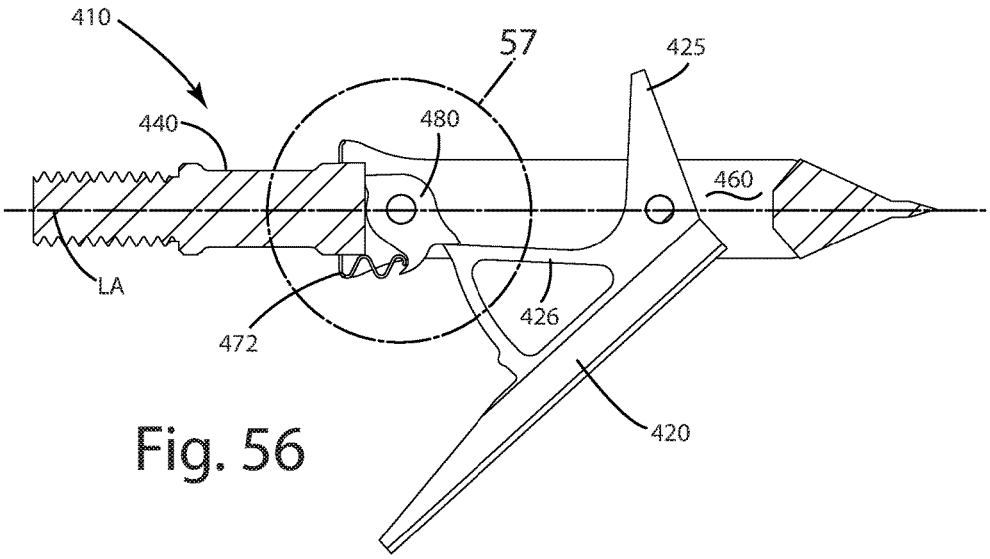
FIG. 56 is a section view of the broadhead with the blades oriented in a deployed mode taken along lines 56-56 of FIG. 53.

Generally, the biasing element 472 can be configured to urge selective rotation of the pawl 480 in a counterclockwise direction as shown for example in FIGS. 55 and 57. When the cutting blade 420 is in a retracted mode as shown in FIG. 55, the second tooth 482 engages a recess or notch 472 defined on the retention arm 426 or generally on the interior edge 422 of the blade. When the lever arm 425 exerts a sufficient rotational force on the cutting blade 420 upon impact with a target, the blade 420 rotates, thereby disengaging the tooth 482 from that notch or recess 472 in the blade. In turn, the tooth 482 can slide relative to the retention arm until the hold-open portion 426H passes the tooth 482 as shown in FIG. 57. After it passes the tooth tip, the opposite side of the tooth engages the hold-open portion 426H and prevents the cutting blade 420 from rotating to the retracted mode from the deployed mode. As noted above, to precisely limit the amount of rotation and engagement of the tooth with the hold-open portion, the pawl can include a pawl stop 486 that engages the bottom wall 463 or some other surface adjacent the pawl to selectively limit rotation thereof, for example, in the counterclockwise CC direction. As with the other embodiments herein, because the hold-open portion 426H barely engages the tooth 482, the associated cutting blade 420 can pivot or rotate forward to provide an anti-barbing effect.

Figure 58:
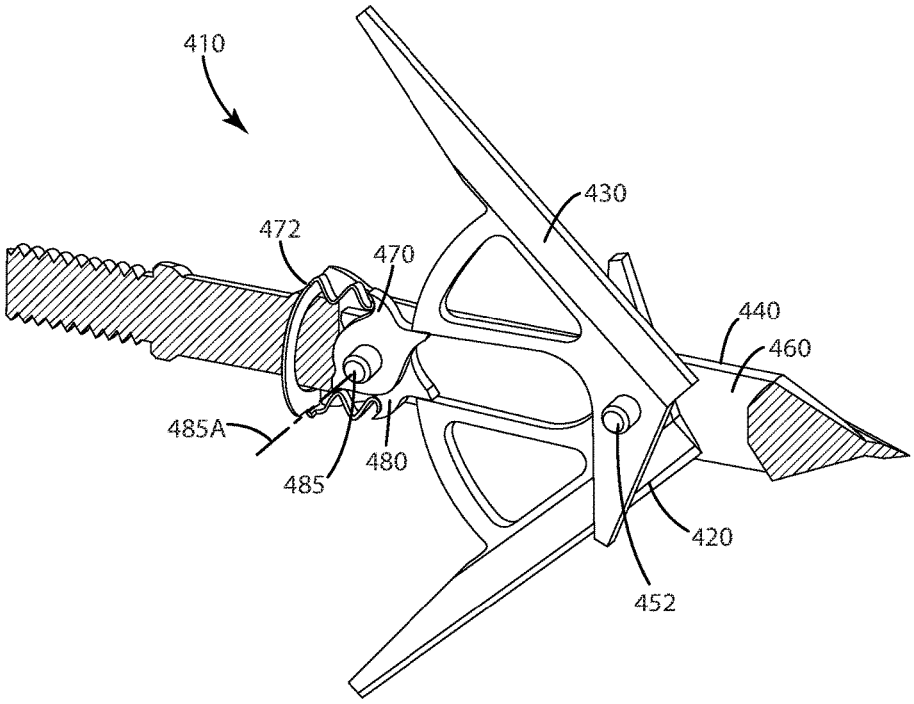
FIG. 58 is a perspective section view of the broadhead in a deployed mode.
Figure 59:
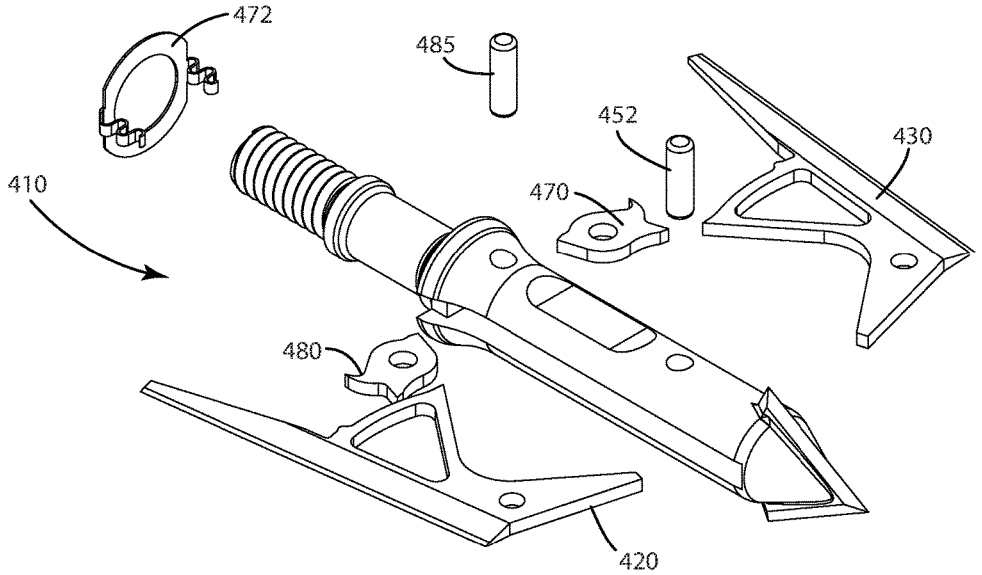
FIG. 59 is an exploded view of the broadhead with the blades oriented in a retracted mode.
Figure 60:
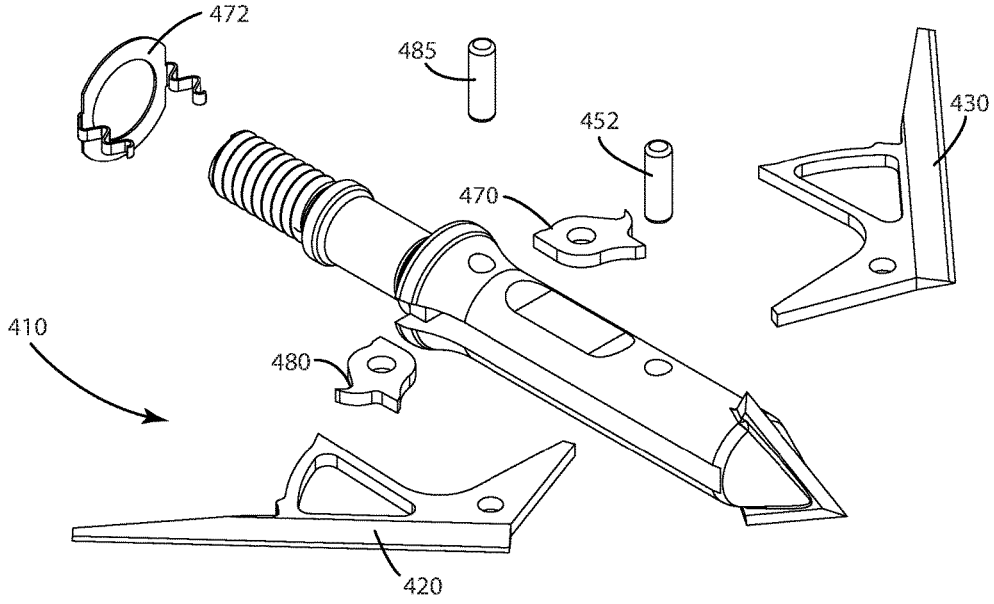
FIG. 60 is an exploded view of the broadhead with the blades oriented in a deployed mode.
Figure 61:
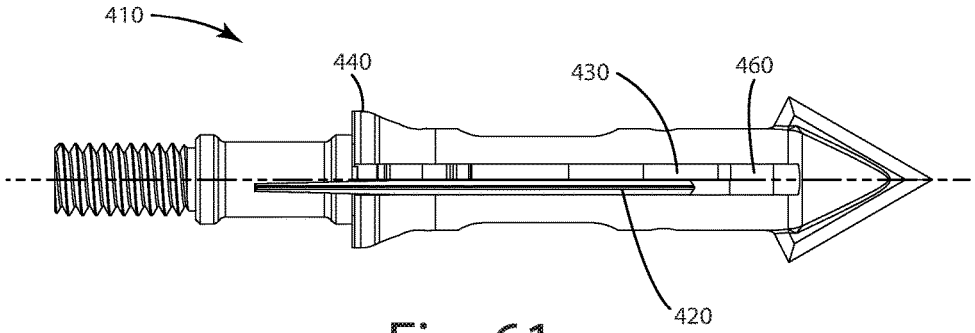
FIG. 61 is a side view of the broadhead with the cutting blades thereof in a retracted mode.
Figure 62:
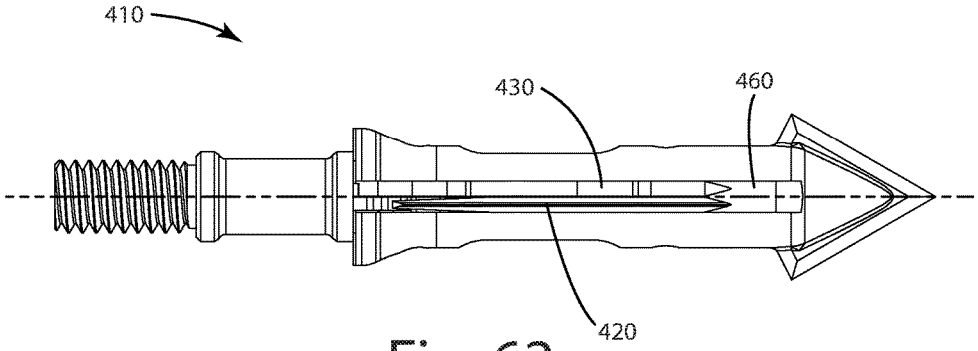
FIG. 62 is a side view of the broadhead with the cutting blades thereof in a deployed mode.

As shown in FIG. 58, it can be seen that the broadhead 410 can be outfitting with two pawls that are configured to selectively engage the respective first cutting blade 420 and second cutting blade 430 to hold those cutting blades in the retracted mode or the deployed mode. That figure also illustrates the pawls 470 and 480 can be disposed adjacent one another, side by side in the longitudinal slot 460. It will also be appreciated that the pawls can rotate in opposite directions when selectively engaging the first and second cutting blades in either of the retracted mode and/or the deployed mode.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A broadhead comprising:

a ferrule defining a blade slot, the ferrule including a longitudinal axis;

a first cutting blade mounted in the slot and adapted to pivot about a pivot axis, from a retracted, in flight mode to a deployed, penetrating mode, the first cutting blade including a cutting edge disposed opposite an interior edge, the first cutting blade including a first lever arm extending from the interior edge, the first lever arm projecting from the slot on a first side of the longitudinal axis, opposite a second side of the longitudinal axis from which the cutting edge extends from the longitudinal slot;

a pawl pivotally joined with the ferrule and configured to selectively engage the first cutting blade to assist in at least one of retaining the first cutting blade in the retracted mode, and retaining the first cutting blade in the deployed mode, wherein the pawl includes a pawl tooth configured to selectively engage the first cutting blade, wherein the pawl includes a pawl stop disposed on an opposite side of the longitudinal axis from the pawl tooth.

* * * * *